US010119269B2

(12) United States Patent
Perdue

(10) Patent No.: US 10,119,269 B2
(45) Date of Patent: Nov. 6, 2018

(54) VARIABLE ACOUSTIC ASSEMBLY AND METHOD OF USE

(71) Applicant: JayVic, Inc., Amarillo, TX (US)

(72) Inventor: Joab Jay Perdue, Amarillo, TX (US)

( * ) Notice: Subject to any disclaimer, the term of this patent is extended or adjusted under 35 U.S.C. 154(b) by 0 days.

(21) Appl. No.: 15/207,311

(22) Filed: Jul. 11, 2016

(65) Prior Publication Data

US 2018/0010334 A1 Jan. 11, 2018

(51) Int. Cl.

| | |
|---|---|
| ***E04B 1/99*** | (2006.01) |
| ***G10K 11/16*** | (2006.01) |
| ***E04B 1/82*** | (2006.01) |
| ***G10K 11/00*** | (2006.01) |
| ***G10K 11/162*** | (2006.01) |
| ***G10K 11/26*** | (2006.01) |
| *H04R 1/02* | (2006.01) |

(52) U.S. Cl.
CPC ..... *E04B 1/994* (2013.01); *E04B 1/8209* (2013.01); *G10K 11/004* (2013.01); *G10K 11/162* (2013.01); *G10K 11/26* (2013.01); *H04R 1/02* (2013.01)

(58) Field of Classification Search
CPC ..... E04B 1/994; E04B 1/99; E04B 1/8209; E04B 1/8218; E04B 1/8227; E04B 1/8236; E04B 1/8423; E04B 1/8433; E04B 1/8438; E04B 1/8452; E04B 2001/8476; E04B 2001/849; E04B 2001/7695; E06B 5/20
See application file for complete search history.

(56) References Cited

U.S. PATENT DOCUMENTS

| | | | | | |
|---|---|---|---|---|---|
| 267,007 | A | * | 11/1882 | Lott | E06B 9/165 160/135 |
| 1,825,465 | A | | 9/1931 | Macdonald et al. | |
| 1,896,844 | A | * | 2/1933 | Hanson | E04B 1/994 181/30 |
| 1,975,604 | A | * | 10/1934 | Hanson | E04B 1/994 181/287 |
| 2,855,039 | A | * | 10/1958 | Gross | E04B 1/8209 160/236 |
| 3,007,539 | A | * | 11/1961 | Brewer | G10K 11/20 160/165 |
| 3,049,190 | A | * | 8/1962 | Coffman | E04B 1/994 160/114 |

(Continued)

FOREIGN PATENT DOCUMENTS

| | | | | | |
|---|---|---|---|---|---|
| DE | 2724717 | A1 | * | 12/1978 | E04B 1/994 |
| WO | WO 0242574 | A1 | * | 5/2002 | E04B 1/994 |
| WO | WO 2016203278 | A1 | * | 12/2016 | E04B 1/994 |

*Primary Examiner* — Edgardo San Martin
(74) *Attorney, Agent, or Firm* — Shannon L Warren

(57) ABSTRACT

A variable acoustic assembly comprising a housing and a one or more absorbing pads. The housing contains the one or more absorbing pads, a one or more doors, a one or more rear brackets, and a one or more hinges. The one or more doors attach to the one or more rear brackets with the one or more hinges. The one or more doors are configured to selectively open and selectively close between an open configuration and a closed configuration by rotating on the one or more hinges. The variable acoustic assembly having a closed width in the closed configuration and an open width in the open configuration. With the one or more doors in the open configuration, a portion of the one or more absorbing pads are exposed outside of the housing.

18 Claims, 32 Drawing Sheets

(56) References Cited

U.S. PATENT DOCUMENTS

| | | | | | |
|---|---|---|---|---|---|
| 3,382,947 | A * | 5/1968 | Biggs | E04B 1/994 | 181/30 |
| 3,411,605 | A * | 11/1968 | Coffman | E04B 1/994 | 181/30 |
| 3,590,354 | A * | 6/1971 | Shiflet | E04B 1/994 | 181/30 |
| 4,875,312 | A * | 10/1989 | Schwartz | E04B 1/994 | 181/287 |
| 5,700,052 | A * | 12/1997 | Yamazaki | A47C 1/12 | 181/295 |
| 6,158,176 | A | 12/2000 | Perdue | | |
| 6,209,680 | B1 | 4/2001 | Perdue | | |
| 7,565,951 | B1 | 7/2009 | Perdue | | |
| 8,083,023 | B1 | 12/2011 | Perdue et al. | | |
| 8,573,356 | B1 | 11/2013 | Perdue | | |
| 8,739,925 | B1 | 6/2014 | Perdue | | |
| 9,322,165 | B2 * | 4/2016 | Luhtala | E04B 1/84 | |
| 9,414,697 | B2 * | 8/2016 | Parshad | A47G 5/00 | |
| 2002/0175023 | A1 * | 11/2002 | Wilson | F01N 1/165 | 181/254 |
| 2003/0006092 | A1 * | 1/2003 | D'Antonio | E04B 1/86 | 181/293 |
| 2010/0198426 | A1 * | 8/2010 | Kondo | G10K 11/28 | 700/302 |
| 2016/0356036 | A1 * | 12/2016 | Ryan | E04B 1/994 | |

* cited by examiner 1800,
2602

1800,
2604

1800,
2606

1800,
2608

VARIABLE ACOUSTIC ASSEMBLY AND METHOD OF USE

CROSS-REFERENCE TO RELATED APPLICATIONS

This application is the nonprovisional version of previously filed U.S. Patent Application No. 62/159,317 filed on 2015 May 10. It claims benefit of that earlier application and hereby incorporates it by reference. A petition in conjunction with this claim of priority is submitted herewith.

STATEMENT REGARDING FEDERALLY SPONSORED RESEARCH OR DEVELOPMENT (IF APPLICABLE)

Not applicable.

REFERENCE TO SEQUENCE LISTING, A TABLE, OR A COMPUTER PROGRAM LISTING COMPACT DISC APPENDIX (IF APPLICABLE)

Not applicable.

BACKGROUND OF THE INVENTION

This disclosure relates generally to a variable acoustic assembly and method of use. Examples of acoustic assemblies can be found in U.S. Pat. No. 7,469,485, U.S. Pat. No. 6,050,864, U.S. Pat. No. 8,083,023, U.S. Pat. No. 7,565,951, U.S. Pat. No. 7,661,501, U.S. Pat. No. 8,573,356, U.S. Pat. No. 8,739,925, U.S. Pat. No. 8,739,925, U.S. Pat. No. 6,158,176, U.S. Pat. No. 6,209,680, and U.S. Pat. No. 1,825,465. However, none of the known inventions and patents, taken either singularly or in combination, is seen to describe the instant disclosure as claimed.

BRIEF SUMMARY OF THE INVENTION

A variable acoustic assembly and a method of using the same are disclosed.

Said variable acoustic assembly comprising a housing and a one or more absorbing pads. Said housing contains said one or more absorbing pads. Said housing comprises a one or more doors, a one or more rear brackets, and a one or more hinges. Said one or more doors attach to said one or more rear brackets with said one or more hinges. Said one or more doors are configured to selectively open and selectively close between an open configuration and a closed configuration by rotating on said one or more hinges. Said variable acoustic assembly having a closed width in said closed configuration and an open width in said open configuration. With said one or more doors in said open configuration, a portion of said one or more absorbing pads are exposed outside of said housing; and with said one or more doors in said closed configuration, said one or more absorbing pads are concealed inside of said housing.

Said method of using a variable acoustic assembly, comprising: arranging a one or more variable acoustic assemblies on a surface, transitioning said variable acoustic assembly between a closed configuration and an open configuration, exposing a portion of a one or more absorbing pads with said variable acoustic assembly in said open configuration so as to absorb a sound energy directed toward said variable acoustic assembly, and concealing said one or more absorbing pads and exposing a portion of a housing with said variable acoustic assembly in said closed configuration so as to diffuse said sound energy directed toward said variable acoustic assembly. Said variable acoustic assembly comprising said housing and said one or more absorbing pads. Said housing contains said one or more absorbing pads. Said housing comprises said one or more doors, a one or more rear brackets, and a one or more hinges. Said one or more doors attach to said one or more rear brackets with said one or more hinges. Said one or more doors are configured to selectively open and selectively close between an open configuration and a closed configuration by rotating on said one or more hinges.

DETAILED DESCRIPTION OF THE INVENTION

Many sound engineers for multi-use performance spaces suffer under a conflict between musicians and orators. Consider, for example, a theater which may be used to host a play one night and a musical the next. A play, often being primarily dialog without music, would prefer a sound environment favorable to spoken words which eliminates echoes and loud uncontrolled noises. These characteristics may be desirable in churches, schools, athletic facilities, and other commercial buildings. A musical or concert, on the other hand, may prefer a sound environment being less controlled to allow sound to reflect within the space.

Some sound spaces may need to host more than one type of performance. For example, a church service may begin with a spoken word, followed by a choir performance, then a quiet reflective time, a spoken message and concluding with a musical performance. This template may be followed by political rallies, comedy shows, or many other performances as would be understood by sound engineers and venue owners.

The current disclosure is a system which may be used to selectively control a sound environment by exposing or concealing acoustic devices, as disclosed below. FIGS. 1-10 represent a preferred embodiment of the system. FIGS. 11-17C represent a similar system with different geometries. FIGS. 18-33D present an embodiment using solid geometries to achieve the goals of the preferred embodiment.

These systems can be used as wall and ceiling acoustical treatments and are designed for absorption, durability, aesthetics, fire protection, and value.

Described herein is a variable acoustic assembly and method of use. The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers' specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

Figure 1:
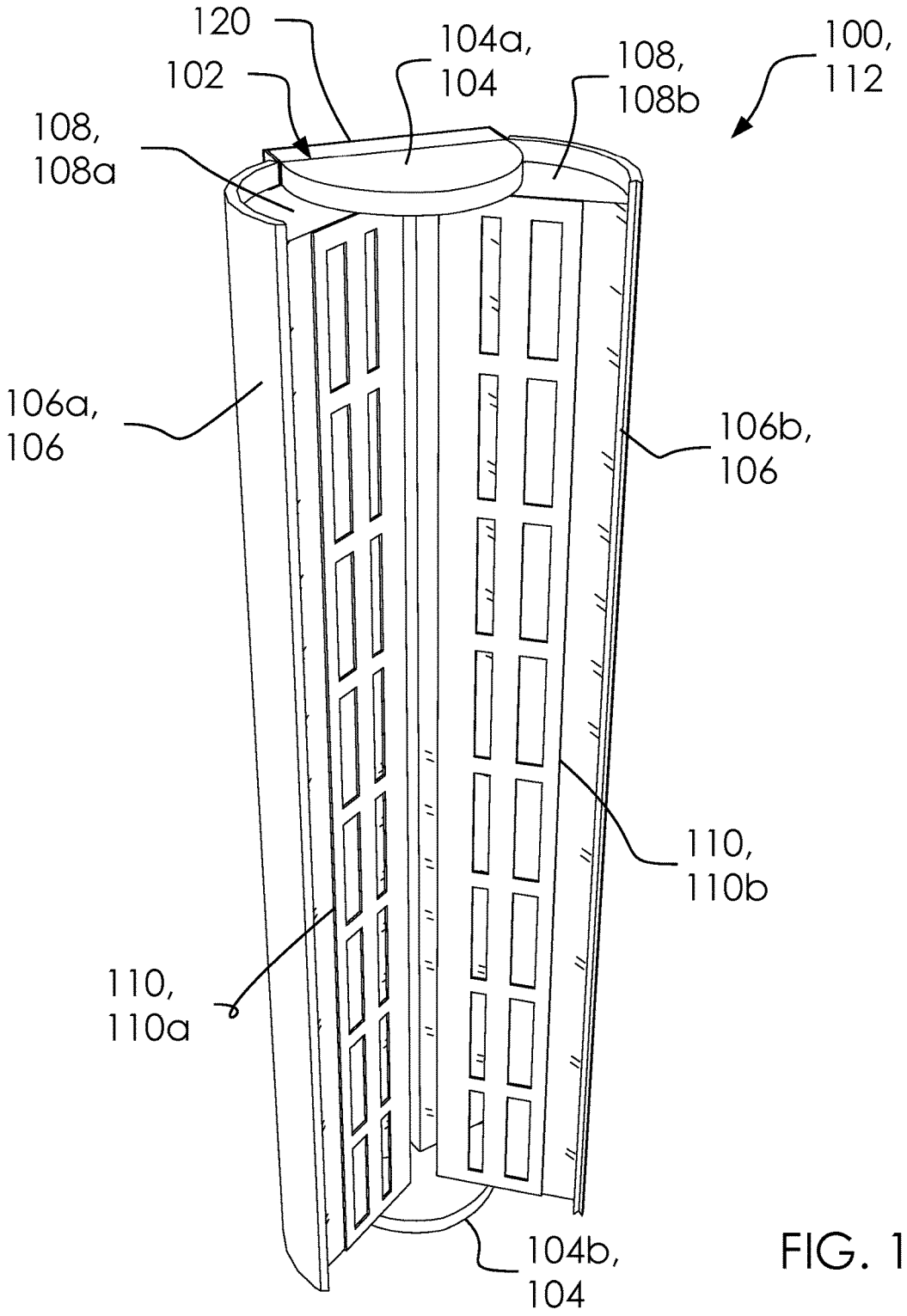
FIG. 1 illustrates a perspective overview of a variable acoustic assembly in a first open configuration.

FIG. 1 illustrates a perspective overview of a variable acoustic assembly 100 in a first open configuration 112.

In one embodiment, said variable acoustic assembly 100 can comprise a housing 102, an end portions 104, a one or more doors 106, a one or more absorbing pads 108, a one or more inner diffusers 110, a back portion 120, and a one or more hinges 314 (not illustrated here). Said end portions 104 can comprise a top portion 104*a*, and a bottom portion 104*b*. Said one or more doors 106 can comprise a first side door 106*a* and a second side door 106*b*. Said one or more absorbing pads 108 can comprise a first absorbing pad 108*a* and a second absorbing pad 108*b*. Said one or more inner diffusers 110 can comprise a first diffuser 110*a* and a second diffuser 110*b*.

In one embodiment, said housing 102 can contain a portion of said variable acoustic assembly 100. In one embodiment, said one or more doors 106 can selectively open and selectively close to expose and conceal said one or more inner diffusers 110 and said one or more absorbing pads 108, as discussed to follow.

In one embodiment, said housing 102 can comprise a rigid material configured to substantially reflect a sound energy directed at said variable acoustic assembly 100.

In a more simplified version of said variable acoustic assembly 100 may comprise only said housing 102, said one or more absorbing pads 108. Wherein, said variable acoustic assembly 100 may selectively reveal portions of said one or more absorbing pads 108 to control a sound environment.

Figure 2A:
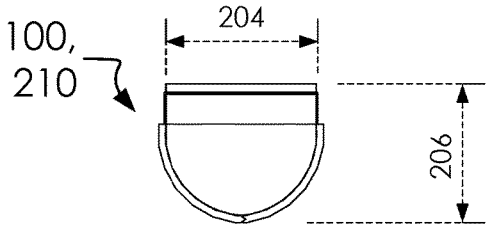
FIG. 2A-2C illustrates an elevated top view, an elevated front view, and an elevated side view of a variable acoustic assembly in a closed configuration.
Figure 2B:
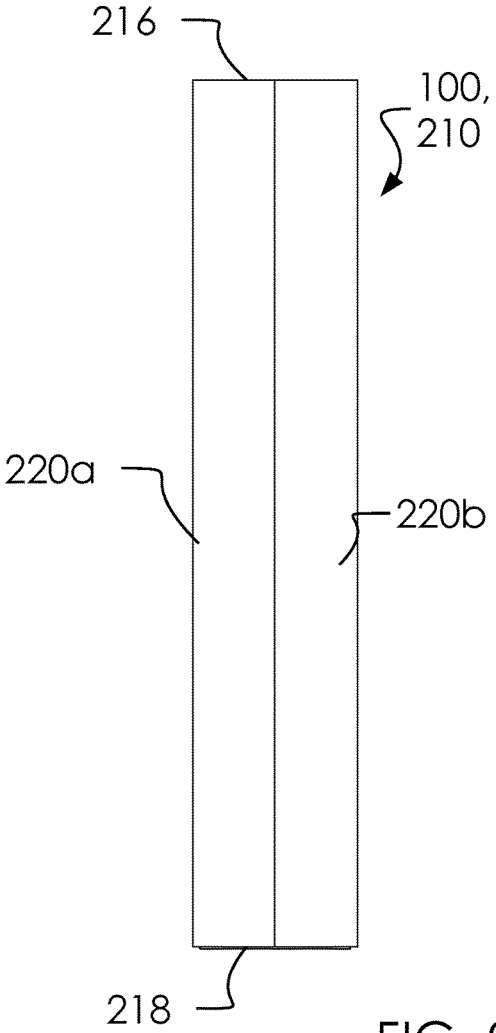
Figure 2C:
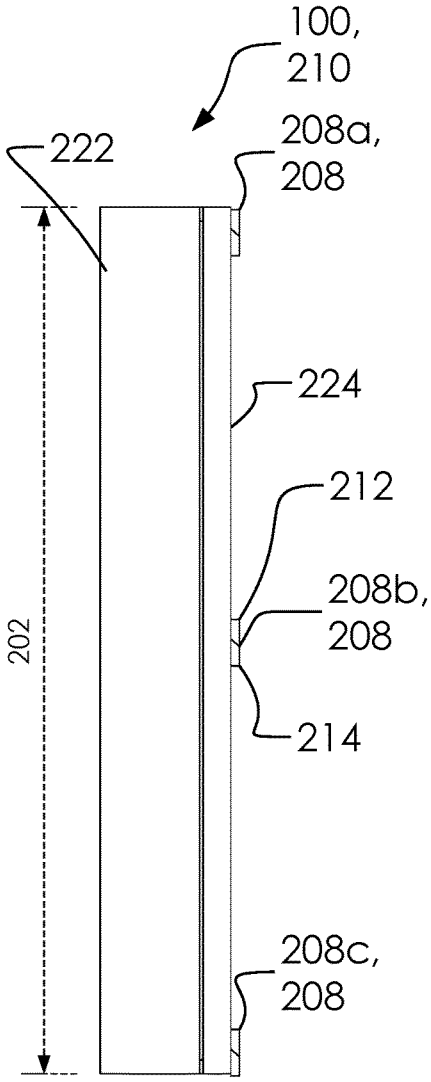

FIG. 2A-2C illustrates an elevated top view, an elevated front view, and an elevated side view of a variable acoustic assembly 100 in a closed configuration 210.

Said variable acoustic assembly 100 can be set into a first open configuration 112, as illustrated in FIG. 1, or in said closed configuration 210, as illustrated in FIGS. 2A-2C.

In one embodiment, said variable acoustic assembly 100 can further comprise a height 202, a closed width 204, a depth 206, a top side 216, a bottom side 218, a first side 220*a*, a second side 220*b*, a front side 222, and a rear side 224.

In one embodiment, said variable acoustic assembly 100 can further comprise a one or more French cleats 208. In one embodiment, said one or more French cleats 208 can comprise a first cleat assembly 208*a*, a second cleat assembly 208*b*, and a third cleat assembly 208*c*. In one embodiment, said one or more French cleats 208 can be useful for hanging said variable acoustic assembly 100 on a surface such as a wall. Each of said one or more French cleats 208 can comprise a first portion 212 and a second portion 214. The functioning of said one or more French cleats 208 are well-known in the art. However, for completeness of disclosure, note that in one embodiment, said second portion 214 can be attached to a wall, and said first portion 212 can be attached to said variable acoustic assembly 100; wherein, said one or more French cleats one or more French cleats 208 can be used to attach said variable acoustic assembly 100 to said wall.

In one embodiment, said closed configuration 210 can comprise said housing 102 substantially sealed so as to conceal said one or more absorbing pads 108 and/or said one or more inner diffusers 110 within said variable acoustic assembly 100.

Figure 3A:
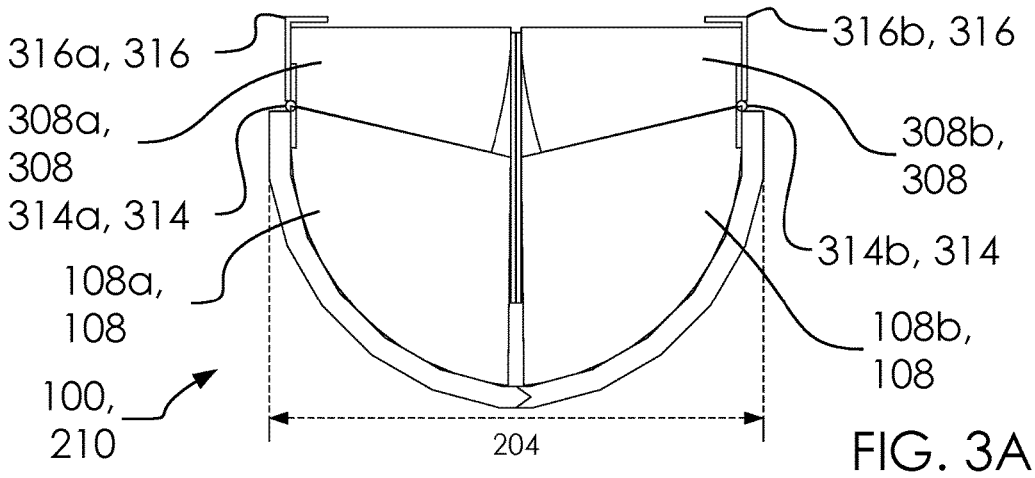
FIGS. 3A, 3B and 3C illustrate an elevated top view of said variable acoustic assembly without said end portions first in said closed configuration, next in said first open configuration and finally in an open configuration.
Figure 3B:
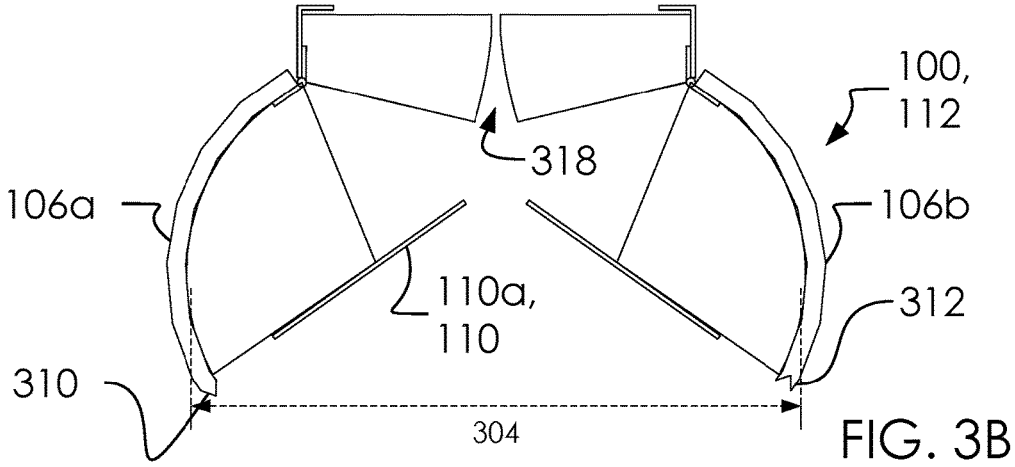
Figure 3C:
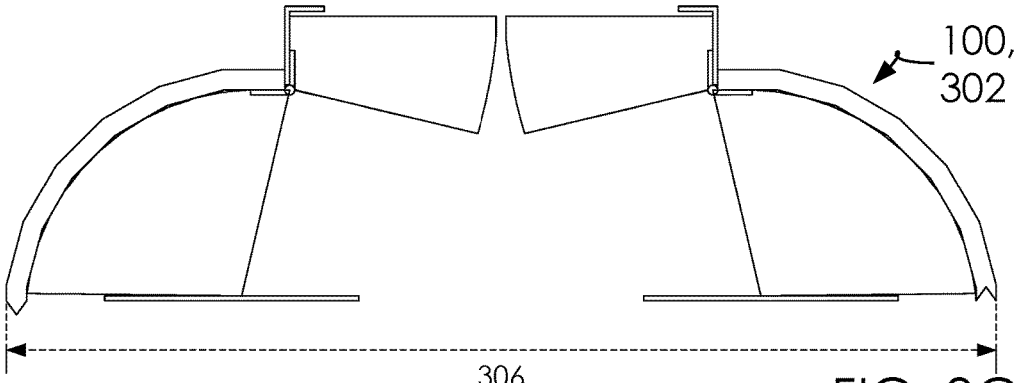

FIGS. 3A, 3B and 3C illustrate an elevated top view of said variable acoustic assembly 100 without said end portions 104; first in said closed configuration 210, next in said first open configuration 112 and finally in an open configuration 302.

As illustrated, said variable acoustic assembly 100 can comprise said open configuration 302 having an open width 306; said first open configuration 112 with a first open width 304; and said closed configuration 210 with said closed width 204.

In one embodiment, said variable acoustic assembly 100 can further comprise a one or more rear absorbing pads 308 (which can comprise a first rear absorbing pad 308*a* and a second rear absorbing pad 308*b*), a concave edge 310 on said first side door 106*a*, a convex edge 312 on said second side door 106*b*, said one or more hinges 314 (which can comprise a first hinge 314*a* and a second hinge 314*b*), a one or more rear brackets 316 (which can comprise a first bracket 316*a* and a second bracket 316*b*), and a rear absorbing pad gap 318.

As illustrated, said variable acoustic assembly 100 can be selectively opened and closed between said closed configuration 210 and said open configuration 302. Said first open configuration 112 is included to illustrate one stage between said closed configuration 210 and said open configuration 302. Note that said open configuration 302 is only limited by the radial distance said one or more hinges 314 are physically able to rotate. It would be understood by one in the art that said variable acoustic assembly 100 could be designed to allow said one or more hinges 314 to rotate further open.

In one embodiment, said one or more inner diffusers 110 can be partially stored between said one or more rear absorbing pads 308 in said rear absorbing pad gap 318 while said variable acoustic assembly 100 is in said closed configuration 210.

In one embodiment, said concave edge 310 and said convex edge 312 can comprise a portion of said one or more doors 106 which selectively nest into one another while said variable acoustic assembly 100 is in said closed configuration 210. In one embodiment, the terms "concave" and "convex" can comprise their plain English meaning, but can also suggest any mating geometries appropriate for creating a seal when said variable acoustic assembly 100 is in said closed configuration 210, as is known in the art.

In one embodiment, said one or more rear absorbing pads 308 can be attached between said one or more rear brackets 316. In one embodiment, said one or more rear brackets one or more rear brackets 316 can be rotateably attached to said one or more doors 106 with said one or more hinges 314. In one embodiment, said one or more hinges 314 can comprise a substantially vertical axis (not illustrated here) which allows said one or more doors 106 to rotate between said closed configuration 210 and said open configuration 302.

In one embodiment, said one or more doors 106 can provide a solid reflective surface for sound waves to bounce against. Likewise, in one embodiment, said one or more rear absorbing pads 308 and said one or more absorbing pads 108 can absorb sound. Finally, said one or more inner diffusers 110 can act as diffusers to sound. A skilled person in the art will manage the state of said variable acoustic assembly 100 to manage acoustic conditions in an environment. As discussed above, a sound engineer or similar party may alter said variable acoustic assembly 100 to customize a performance space for a current performer where some may prefer a reflective sound space while others may prefer an absorbent sound space.

In one embodiment, with said variable acoustic assembly 100 in said closed configuration 210, said front side 222 can comprise a rounded shape. In one embodiment, said one or more doors 106 can cause said front side 222 to substantially form a half circle or parabola (as viewed in FIG. 3A).

In one embodiment, said closed width 204 can comprise 12 inches and said open width 306 can comprise 26 inches. Likewise, in one embodiment, said with said variable acoustic assembly 100 in said open configuration 302, a substantially amount of surface area at various pitches are exposed so as to diffuse and absorb sound energy. Conversely, with said variable acoustic assembly 100 in said closed configuration 210, a relatively small amount of surface area is exposed to sound energy.

In one embodiment, said one or more absorbing pads 108 can be wedge shaped. In one embodiment, said one or more doors 106 are attached to opposite sides of said back portion 120.

In one embodiment, said one or more absorbing pads 108 and said one or more rear absorbing pads 308 can comprise a Rockwool material; and/or a combination of Rockwool and fiberglass.

Figure 4A:
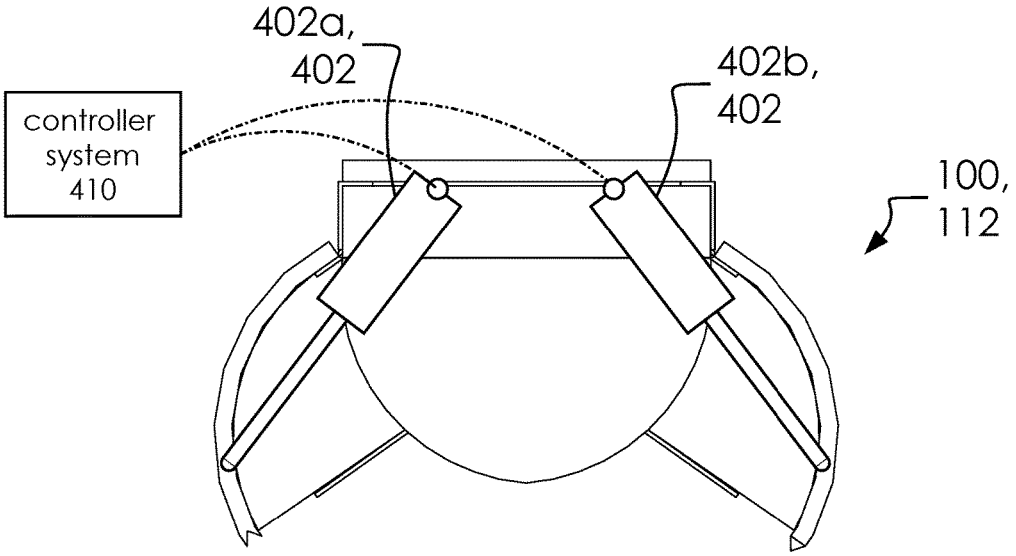
FIGS. 4A and 4B illustrate an elevated top view of said variable acoustic assembly with a controller system, as illustrated.
Figure 4B:
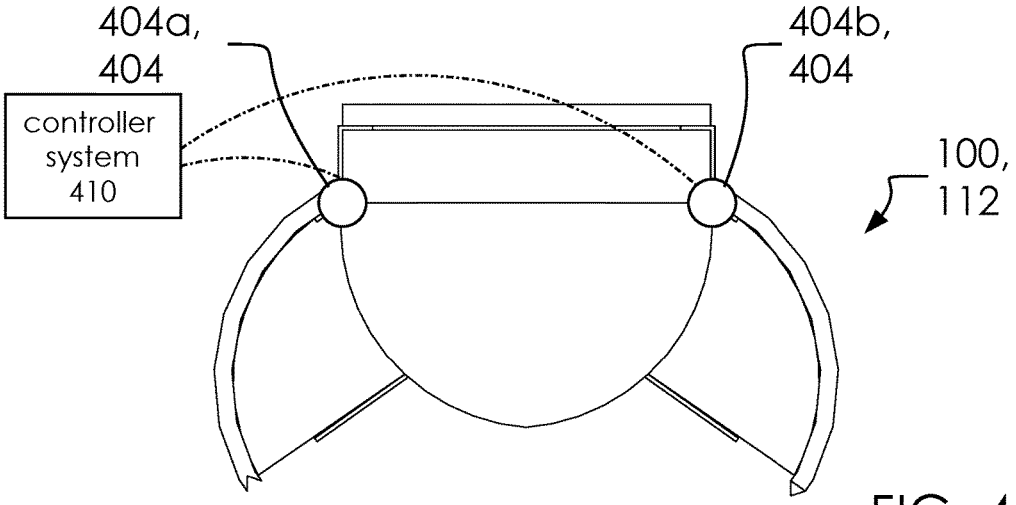

FIGS. 4A and 4B illustrate an elevated top view of said variable acoustic assembly 100 with a controller system 410, as illustrated.

In one embodiment, said variable acoustic assembly 100 can use a linear actuator motors 402 (which can comprise a first LAM 402*a* and a second LAM 402*b*) and/or a one or more rotary motors 404 (which can comprise a first rotary motor 404*a* and a second rotary motor 404*b*) with a controller system 410 to transition between said closed configuration 210 and said open configuration 302.

In one embodiment, said linear actuator motors 402 can open and close said one or more doors 106 by expanding and contracting their length, as is known in the art.

Likewise, in one embodiment, said one or more rotary motors 404 can perform the same action by rotating a motor attached between said one or more doors 106 and said one or more rear brackets 316.

In one embodiment, said controller system 410 can selectively adjust said variable acoustic assembly 100, as is known in the art.

Likewise, in one embodiment, a stepper motor can be used for this procedure.

As illustrated, said linear actuator motors 402 each can comprise a first end attached to a portion of said housing 102 and a second end attached to said one or more doors 106; wherein, said controller system 410 can be selectively engaged to open and close said one or more doors 106 with said linear actuator motors 402. A similar process can be used with said one or more rotary motors 404 using said controller system 410, as would be understood in the art.

Figure 5A:
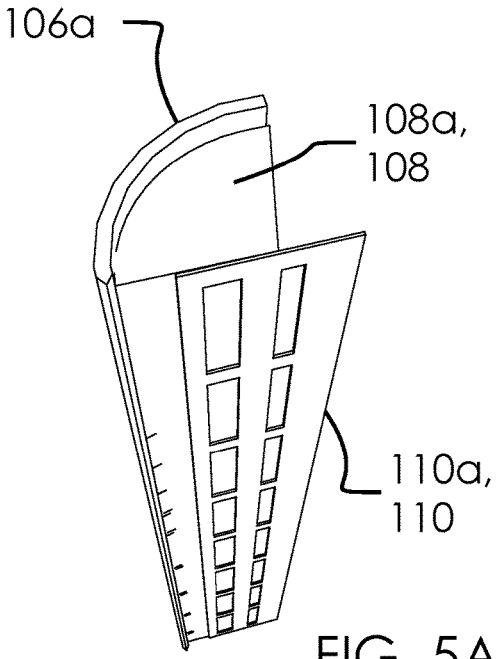
FIGS. 5A and 5B illustrate a perspective overview and an elevated front view of a first diffuser with said first rear absorbing pad and said first diffuser.
Figure 5B:
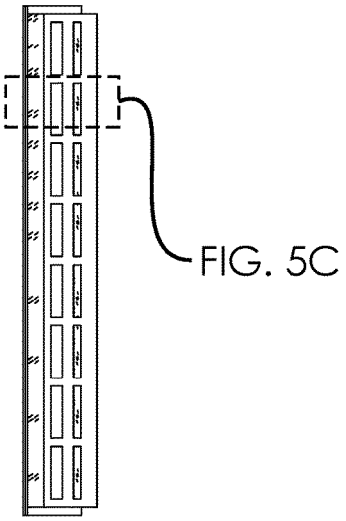
Figure 5C:
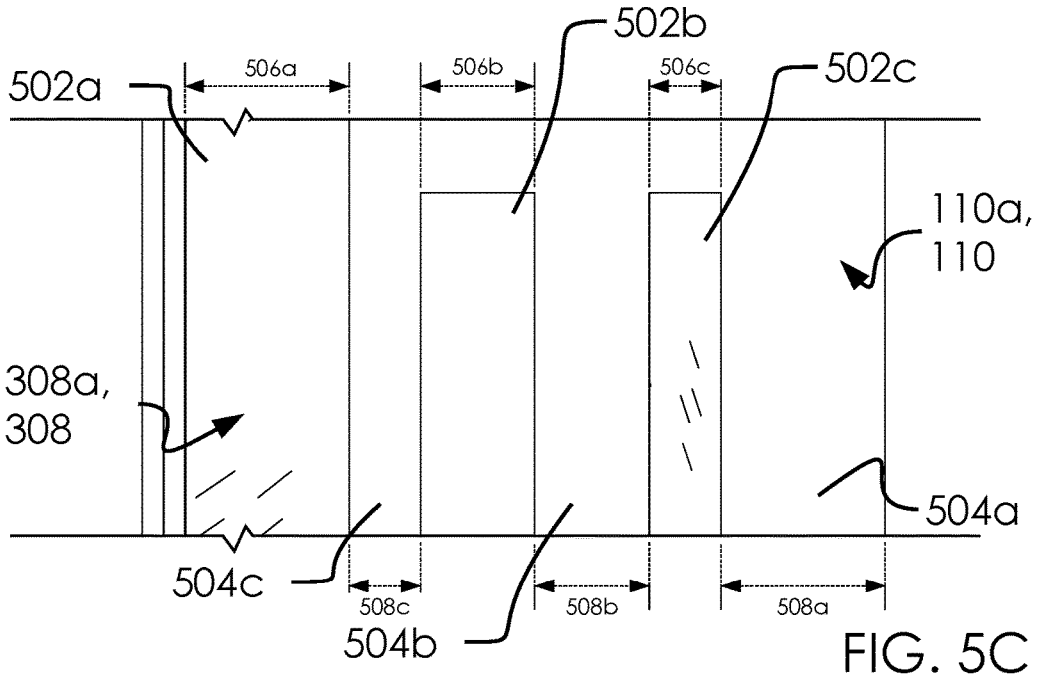
FIG. 5C illustrates an elevated top view of a detailed portion of said first diffuser with said first rear absorbing pad.

FIGS. 5A and 5B illustrate a perspective overview and an elevated front view of a first diffuser 110*a* with said first rear absorbing pad 308*a* and said first diffuser 110*a*. FIG. 5C illustrates an elevated top view of a detailed portion of said first diffuser 110*a* with said first rear absorbing pad 308*a*.

In one embodiment, said one or more inner diffusers 110 can comprise a one or more diffusing gaps 502 (which can comprise a first gap 502*a*, a second gap 502*b* and a third gap 502*c*), and a one or more diffusing portions 504 (which can comprise a first diffusing portion 504*a*, a second diffusing portion 504*b*, and a third diffusing portion 504*c*). Said first gap 502*a* can comprise a first gap width 506*a*, said second gap 502*b* can comprise a second gap width 506*b*, and said third gap 502*c* can comprise a third gap width 506*c*. Said first diffusing portion 504*a* can comprise a first diffusing portion width 508*a*, said second diffusing portion 504*b* can comprise a second diffusing portion width 508*b*, and said third diffusing portion 504*c* can comprise a third diffusing portion width 508*c*.

In one embodiment, said first gap 502*a* can comprise a portion of said first rear absorbing pad 308*a*, as illustrated. Thus, said one or more inner diffusers 110 can be attached to said one or more absorbing pads 108 so as to provide for said first gap first gap 502*a*.

In one embodiment, said one or more diffusing gaps 502 and said one or more diffusing portions 504 can be arranged in order to accomplish a binary amplitude diffusion of energy, as is known in the art. For example, in one embodiment, said one or more diffusing gaps 502 and said one or more diffusing portions one or more diffusing portions 504 can comprise a particular proportion to one another and arranged so as to have a ratio of 2.3:1:1.6:1.6:1:2.3, which can be expressed as A:C:B:B:C:A. In this case, this arrangement can be as illustrated, beginning on the left most element to the right most as first gap 502*a*, third diffusing portion 504*c*, second gap 502*b*, second diffusing portion 504*b*, third gap 502*c*, and 504*c*. This arrangement is effective as a diffuser, as is known in the art.

The term binary amplitude diffusion, or binary amplitude phasing, can refer to a geometry used for phasing (or removing out portions of the frequencies) by altering a reflecting surface to absorb portions of frequencies and to reflect others. Accordingly, this geometry this puts frequencies out of phase.

In one embodiment, going to a binary amplitude diffusion can increase overall absorption by said variable acoustic assembly 100.

In one embodiment, said one or more inner diffusers 110 can comprise a ridged material such as a plastic or wood.

Figure 6A:
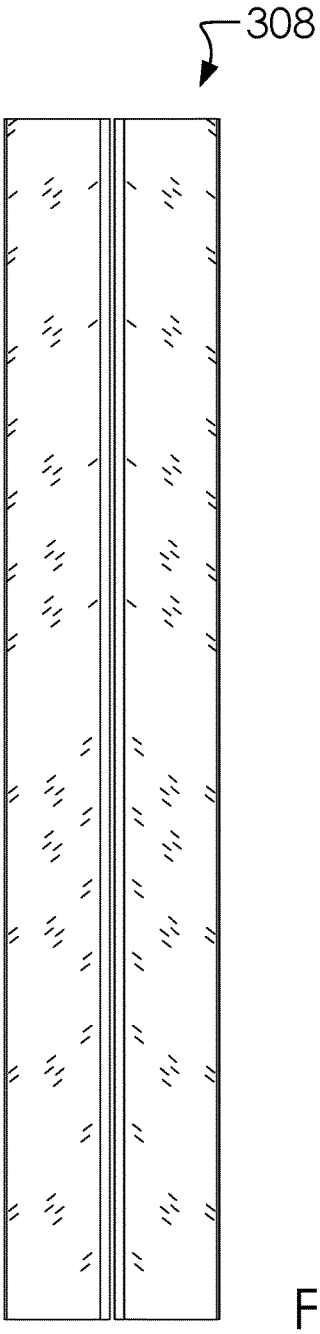
FIG. 6A illustrates an elevated front view of a one or more rear absorbing pads.
Figure 6B:
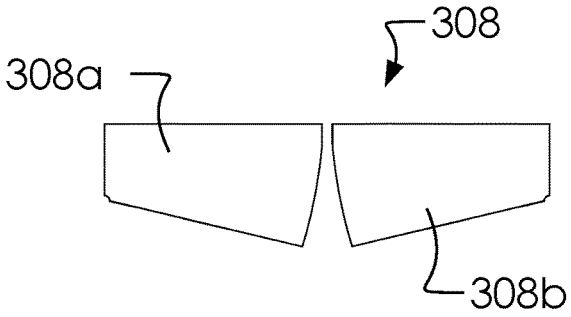
FIG. 6B illustrates an elevated top view of a one or more rear absorbing pads.

FIG. 6A illustrates an elevated front view of a one or more rear absorbing pads 308. FIG. 6B illustrates an elevated top view of a one or more rear absorbing pads 308.

In one embodiment, said one or more rear absorbing pads 308 and said one or more absorbing pads 108 can comprise a sound absorbing material, such as Rockwool wrapped in cloth. In one embodiment, said one or more absorbing pads 108 can be wrapped in fabric or vinyl to suit the aesthetic tastes of users. Alternatively, foam or cotton might be used for said one or more absorbing pads 108.

Figure 7A:
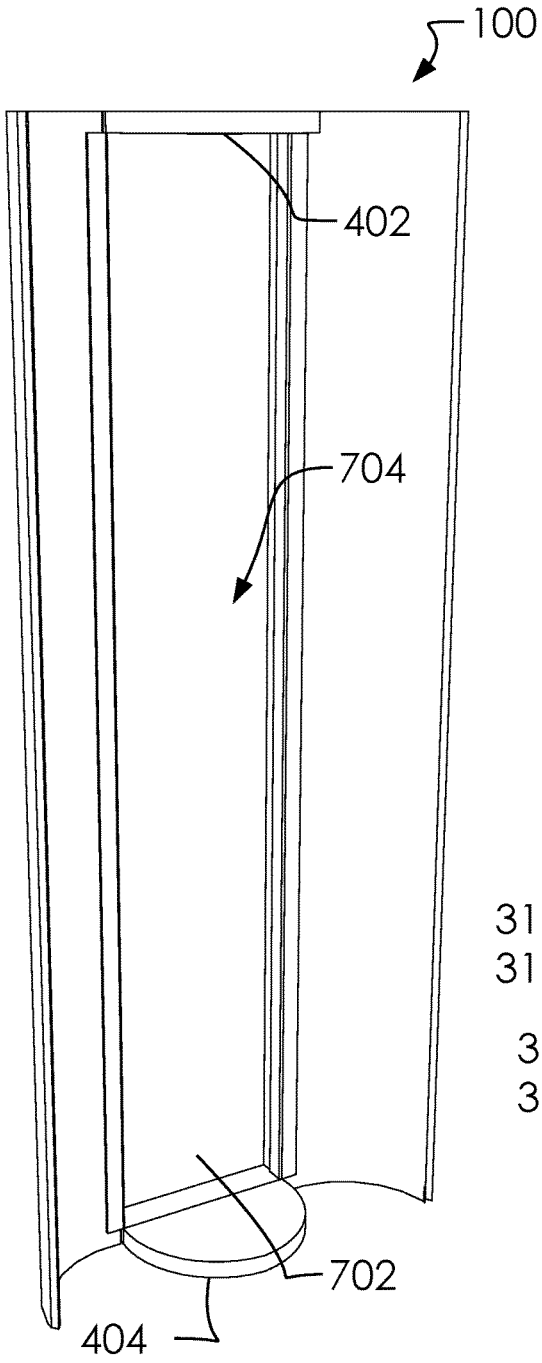
FIGS. 7A and 7B illustrate a perspective front side and rear side view of a housing in said open configuration.
Figure 7B:
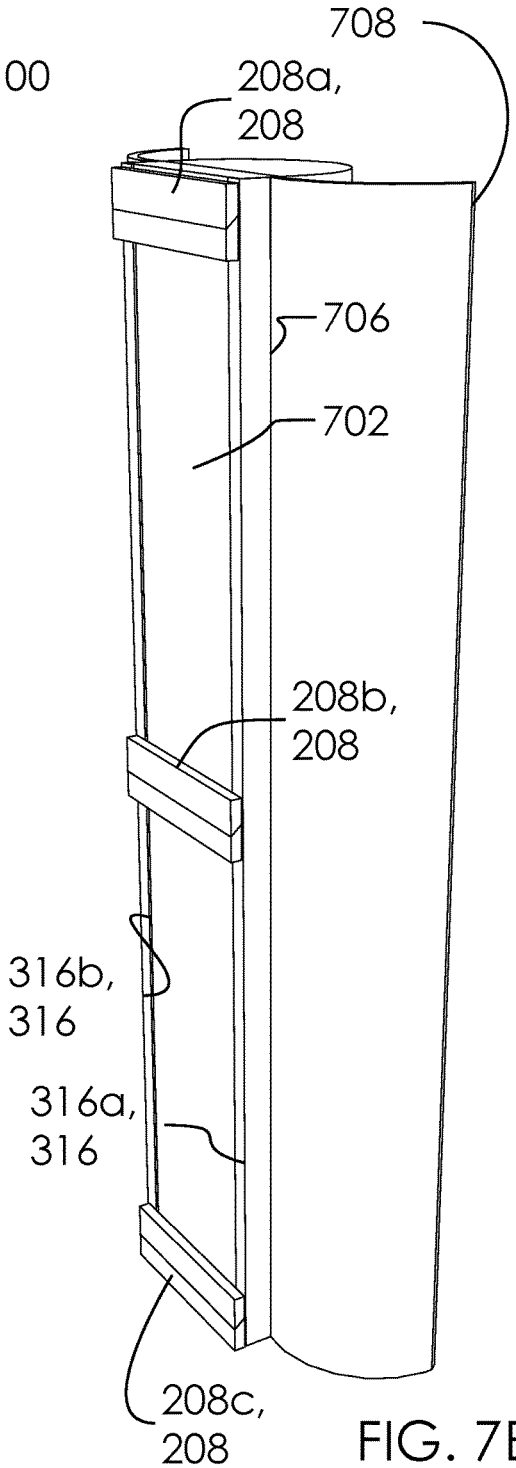

FIGS. 7A and 7B illustrate a perspective front side and rear side view of a housing 106 in said open configuration 302.

In one embodiment, said back portion 120 can comprise said one or more rear brackets 316, said one or more French cleats 208 and/or a rear panel 702.

In one embodiment, said rear panel 702 can comprise a rear portion of said housing 102 between said one or more French cleats 208 at its horizontal sides and said one or more rotary motors 404 and said linear actuator motors 402 at its vertical sides. In one embodiment, said one or more French cleats 208 can be attached to a portion of said rear panel 702 and/or said one or more rear brackets 316, as illustrated.

In one embodiment, said rear panel 702 can comprise a substantially rectangular piece, as illustrated. In one embodiment, said variable acoustic assembly 100 can be built without said rear panel 702.

In one embodiment, an interior volume 704 can comprise an interior space of said housing 102. In one embodiment, said interior volume 704 can be configured for holding said one or more rear absorbing pads 308, said one or more absorbing pads 108 and said one or more inner diffusers 110.

Said one or more doors 106 can each comprise a first vertical edge 706 and a second vertical edge 708. Said first vertical edge 706 of each of said one or more doors 106 can rotateably attach to said one or more hinges 314. Said second vertical edges 708 of said one or more doors 106 selectively seal against one another.

Figure 8A:
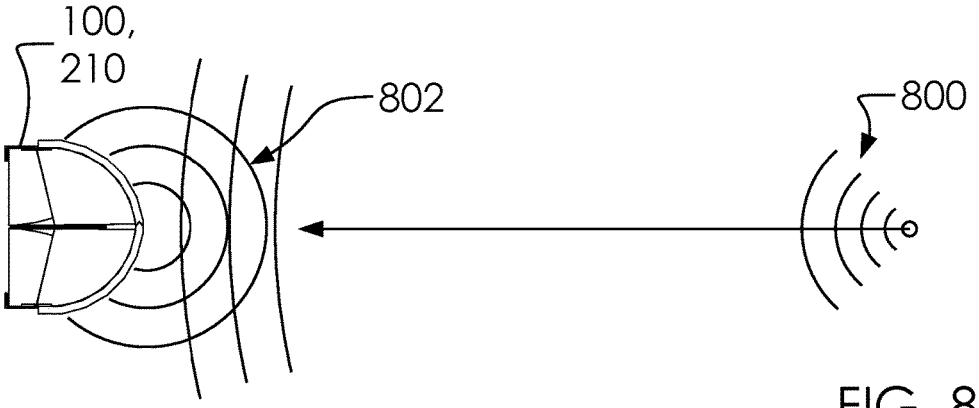
FIGS. 8A, 8B and 8C illustrate said variable acoustic assembly with a sound energy source, with said variable acoustic assembly in said closed configuration, said first open configuration and said open configuration.
Figure 8B:
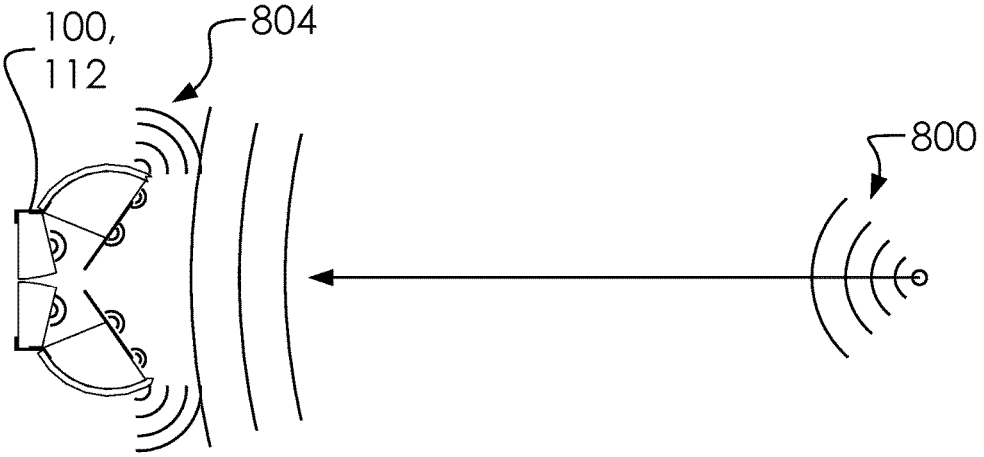
Figure 8C:
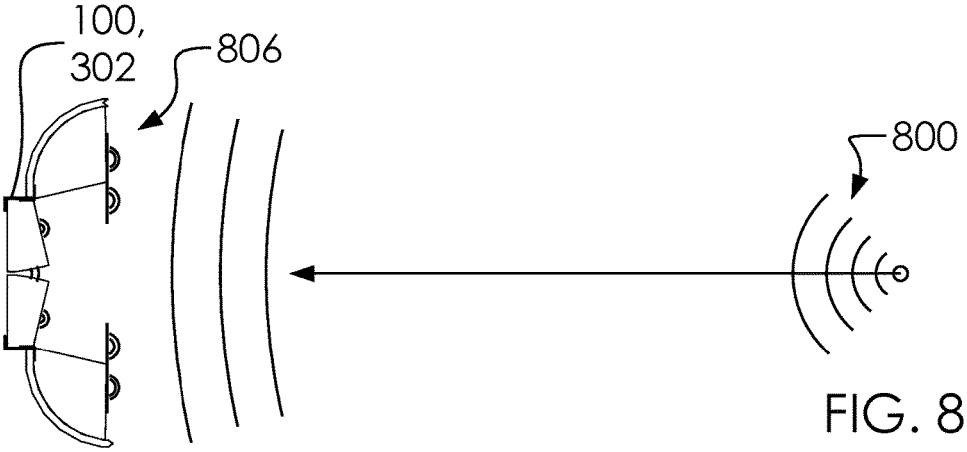

FIGS. 8A, 8B and 8C illustrate said variable acoustic assembly 100 with a sound energy source 800, with said variable acoustic assembly 100 in said closed configuration 210, said first open configuration 112 and said open configuration 302.

Illustrated herein are a sound energy source 800, a first diffused energy 802, a second diffused energy 804, and a third diffused energy 806.

In one embodiment, said variable acoustic assembly 100 comprising a rounded face in said closed configuration 210 can comprise a means of specialization of sound energy, as is known in the art, it can also create more variation in depth and width of absorption.

In one embodiment, said one or more doors 106 can be round so as to direct said sound energy source 800 (being directed at said variable acoustic assembly 100) into multiple directions with said variable acoustic assembly 100 in said closed configuration 210 and/or (partially redirected) while in said first open configuration 112.

In one embodiment, said first diffused energy 802, said second diffused energy 804 and said third diffused energy 806 can comprise three settings between said closed configuration 210 and said open configuration 302 for said one or more inner diffusers 110, and with said variable acoustic assembly 100 being set between those stages of openness, said variable acoustic assembly 100 can create a sound environment according to the desire of a user.

It is noted that said third diffused energy 806 with said variable acoustic assembly 100 in said open configuration 302 is useful for understanding the increased surface are within said variable acoustic assembly 100 which can be used to capture large portions of said sound energy source 800, as is known in the art.

Figure 9A:
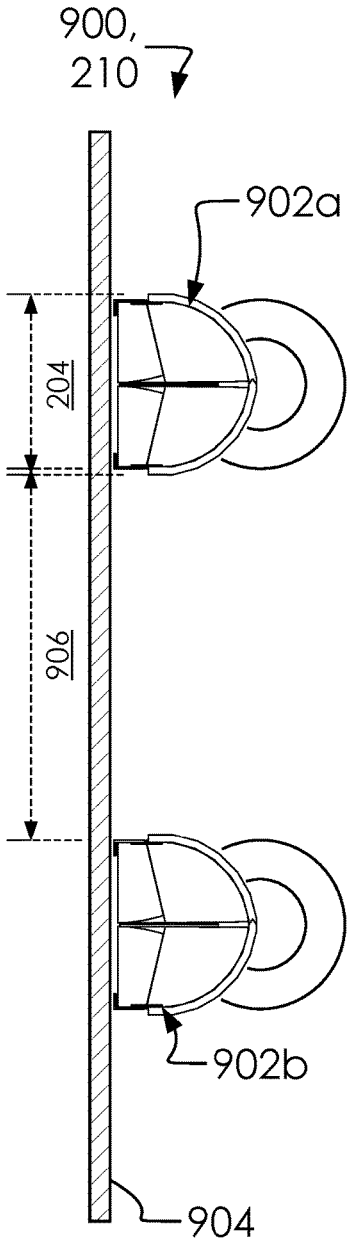
FIGS. 9A and 9B illustrate an elevated top view of a plurality of variable acoustic assemblies in said closed configuration and in said open configuration, respectively.
Figure 9B:
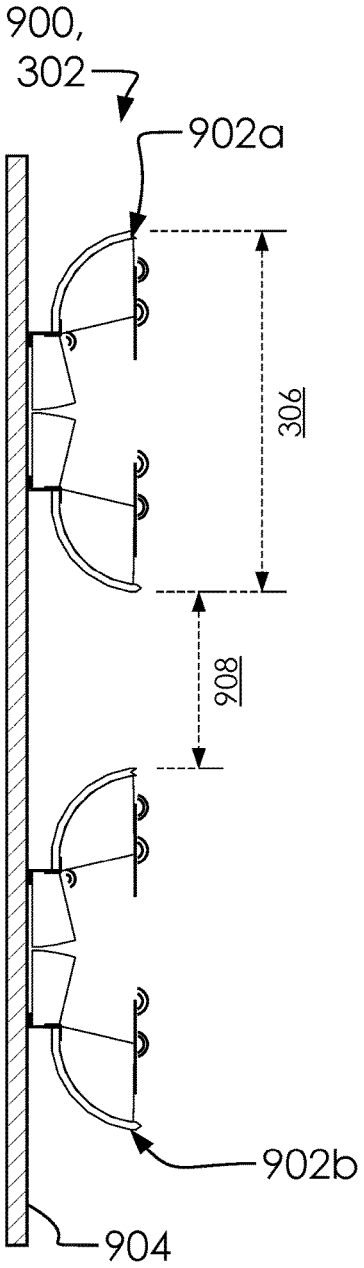

FIGS. 9A and 9B illustrate an elevated top view of a plurality of variable acoustic assemblies 900 in said closed configuration 210 and in said open configuration 302, respectively.

In one embodiment, said plurality of variable acoustic assemblies 900 can comprise said first variable acoustic assembly 902*a* and said second variable acoustic assembly 902*b*.

In one embodiment, said plurality of variable acoustic assemblies 900 can be attached to said surface 904 which can comprise a wall.

In one embodiment, said plurality of variable acoustic assemblies 900 can comprise said first open space 906 in said closed configuration 210 and said second open space 908 in said open configuration 302. In one embodiment, with said 900 in said open configuration 302, said plurality of variable acoustic assemblies 900 can absorb more sound energy by virtue of said open width 306 being larger than said closed width 204 and said second open space second open space 908 be smaller than said first open space 906. Conversely, said plurality of variable acoustic assemblies 900 can diffuse more sound energy since said surface 904 and said plurality of variable acoustic assemblies 900 in said closed configuration 210 are made of harder substances than said one or more inner diffusers 110 and/or said one or more absorbing pads 108 and one or more rear absorbing pads 308.

Figure 10:
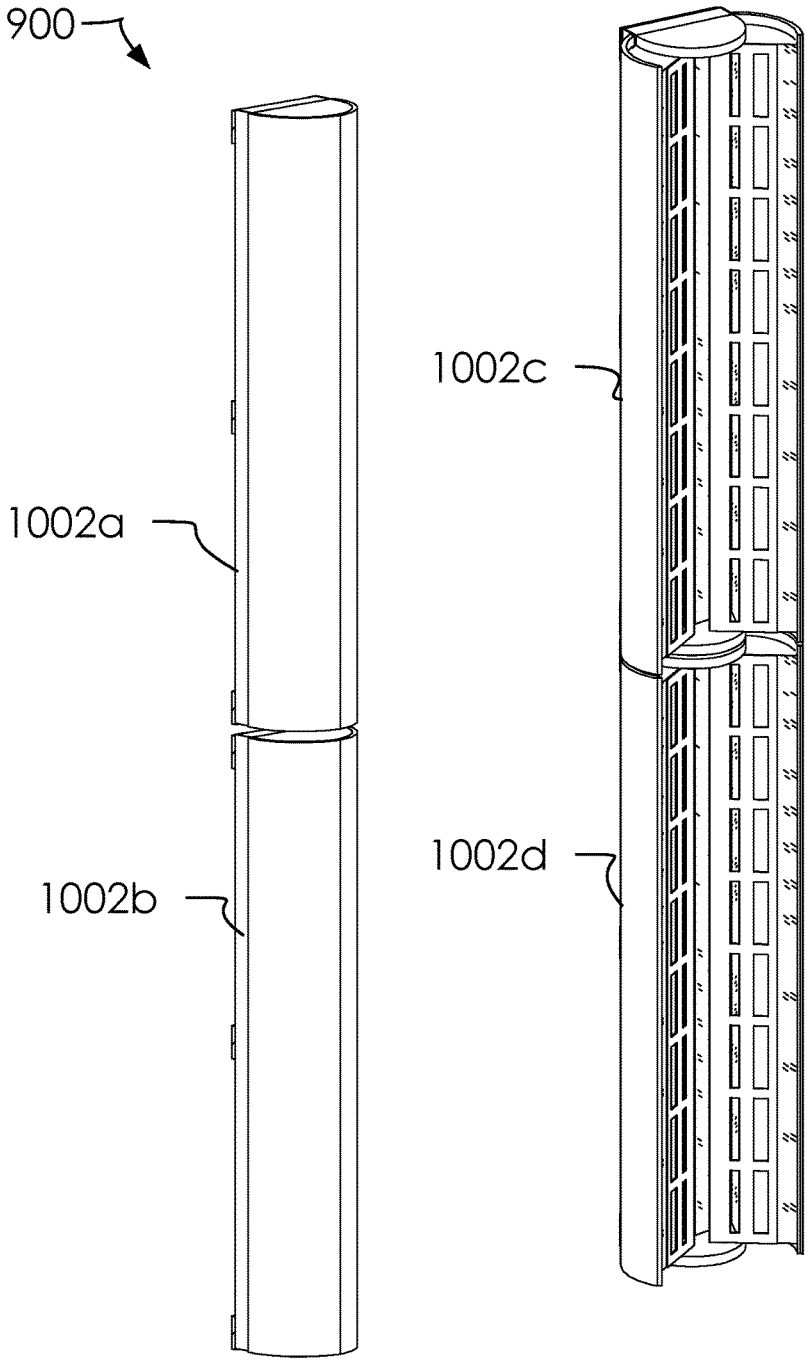
FIG. 10 illustrates an elevated overview of a plurality of variable acoustic assemblies.

FIG. 10 illustrates an elevated overview of a plurality of variable acoustic assemblies 900.

Illustrated herein as said plurality of variable acoustic assemblies 900 are a first closed assembly 1002*a*, a second closed assembly 1002*b*, a first open assembly 1002*c*, and a second open assembly 1002*d*.

In one embodiment, said plurality of variable acoustic assemblies 900 can be arranged vertically with one system stacked on top of another, as with said first closed assembly 1002*a* with said second closed assembly 1002*b*, and said first open assembly 1002*c* with said second open assembly 1002*d*. In one embodiment, a portion of said plurality of variable acoustic assemblies 900 can be in said closed configuration 210 and another portion in another configuration, such as said open configuration 302, as illustrated.

Figure 11:
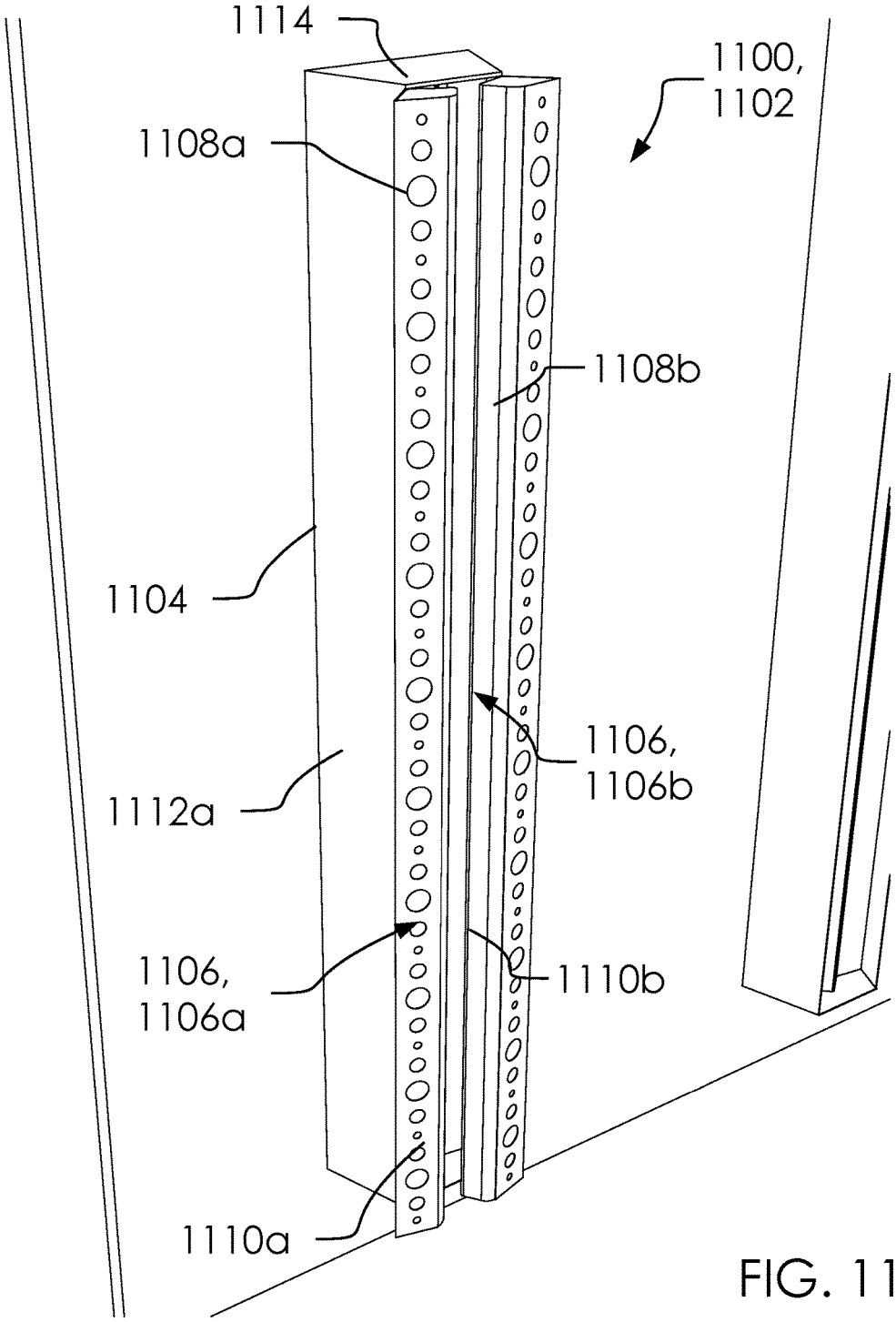
FIG. 11 illustrates a perspective overview of a one or more front faces.

FIG. 11 illustrates a perspective overview of a one or more front faces 1110.

Illustrated herein are a flat surfaced variable acoustic assembly 1100, a closed configuration 1102, a housing 1104, a one or more door assemblies 1106, a first side door assembly 1106*a*, a second side door assembly 1106*b*, a one or more hinges 1108, a first hinge 1108*a*, a second hinge 1108*b*, a one or more front faces 1110, a first front face 1110*a*, a second front face 1110*b*, a one or more side faces 1112, a first side face 1112*a*, a second side face 1112*b*, a top portion 1114, a bottom portion 1116.

Said flat surfaced variable acoustic assembly 1100 can comprise a configuration of said variable acoustic assembly 100 with said housing 102 having a flat shape.

Figure 12:
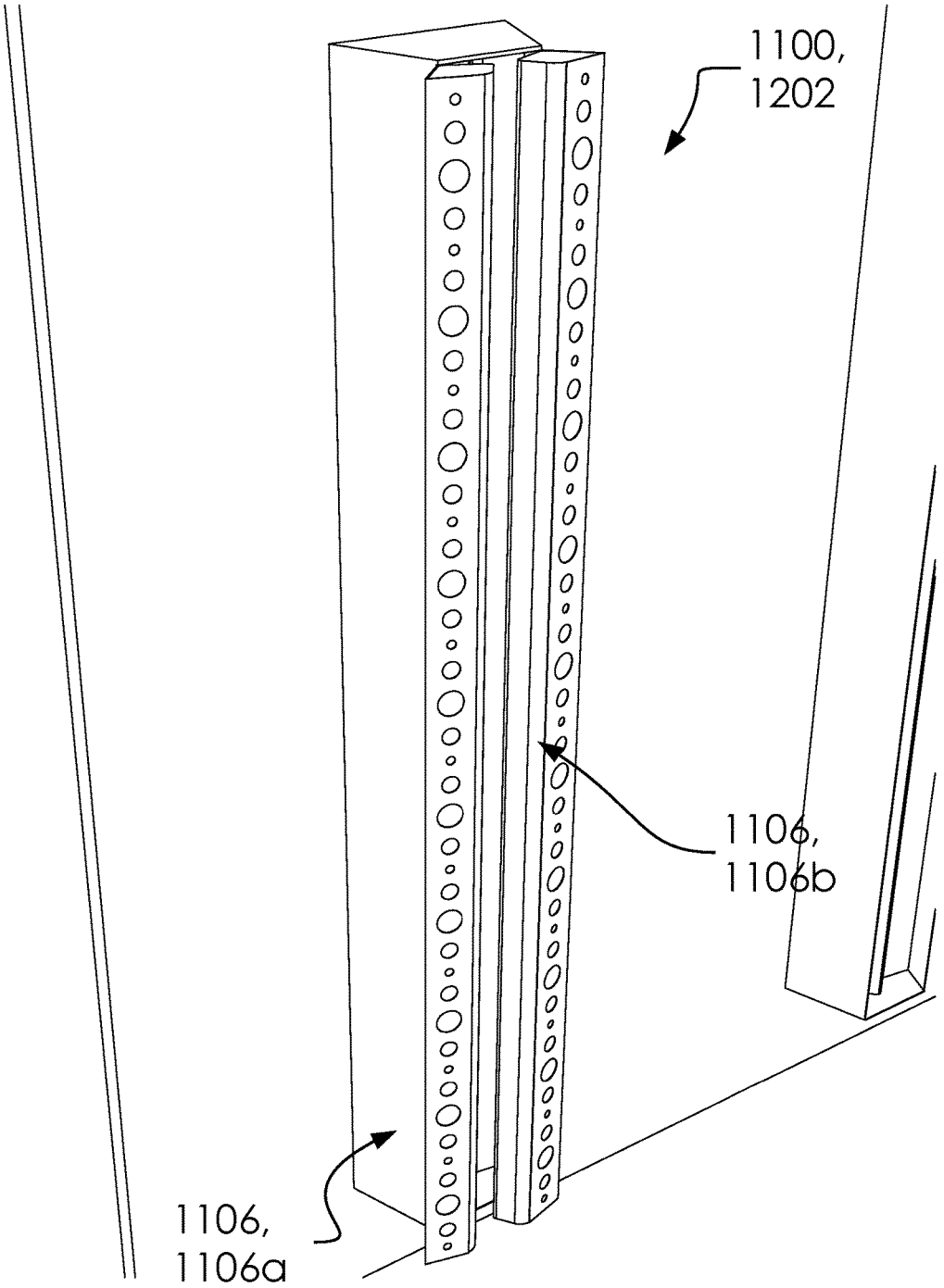
FIG. 12 illustrates a perspective overview said flat surfaced variable acoustic assembly in an open configuration.

FIG. 12 illustrates a perspective overview said flat surfaced variable acoustic assembly 1100 in an open configuration 1202.

Illustrated herein are an open configuration 1202.

Figure 13:
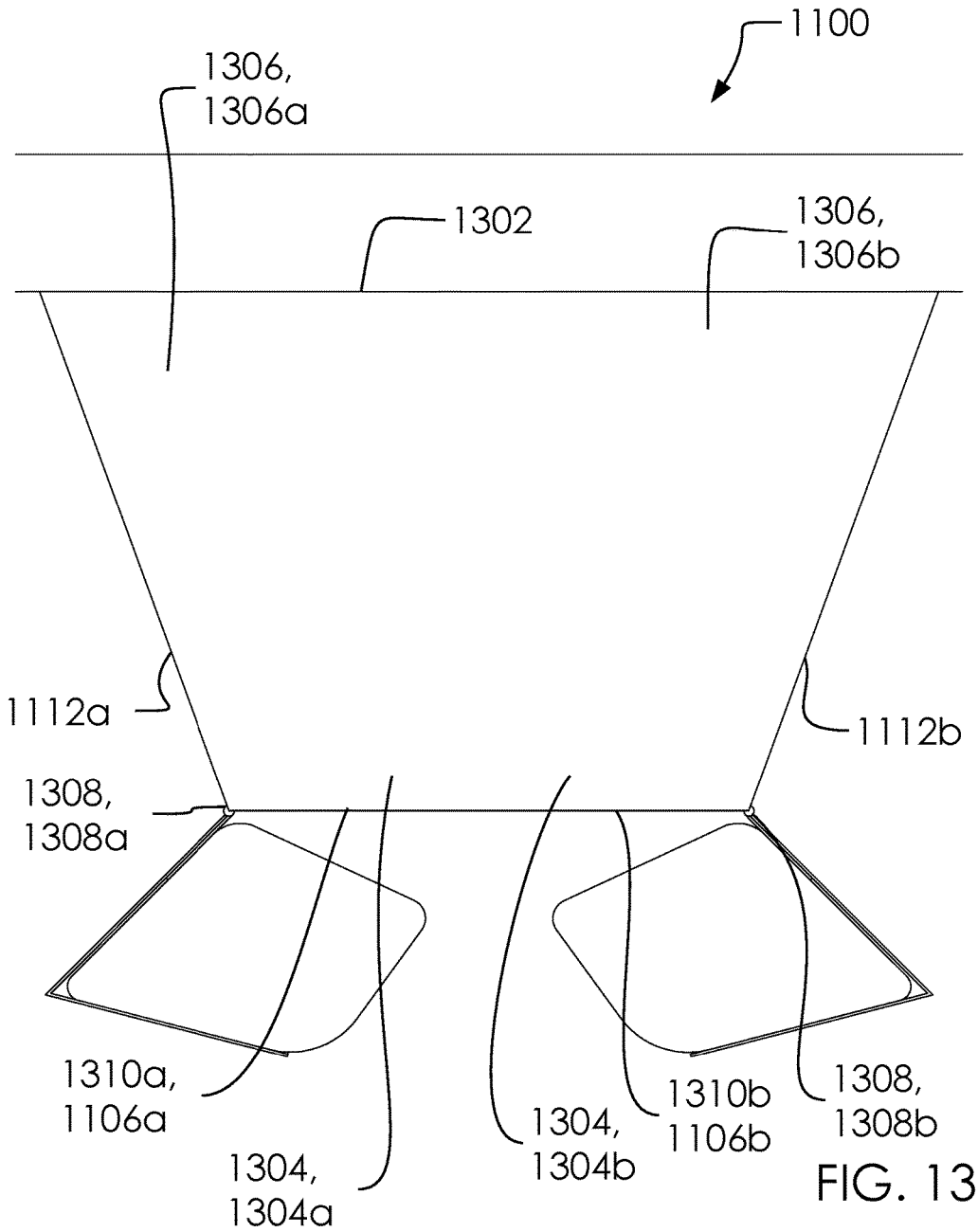
FIG. 13 illustrates an elevated cross-section top view of a flat surfaced variable acoustic assembly.

FIG. 13 illustrates an elevated cross-section top view of a flat surfaced variable acoustic assembly 1100.

Illustrated herein are a backside 1302, a front absorbing pads 1304, a first front absorbing pad 1304*a*, a second front absorbing pad 1304*b*, a back absorbing pads 1306, a first back absorbing pad 1306*a*, a second back absorbing pad 1306*b*, a one or more hinges 1308, a first hinge 1308*a*, a second hinge 1308*b*, a one or more front brackets 1310, a first front bracket 1310*a*, a second front bracket 1310*b*.

Figure 14A:
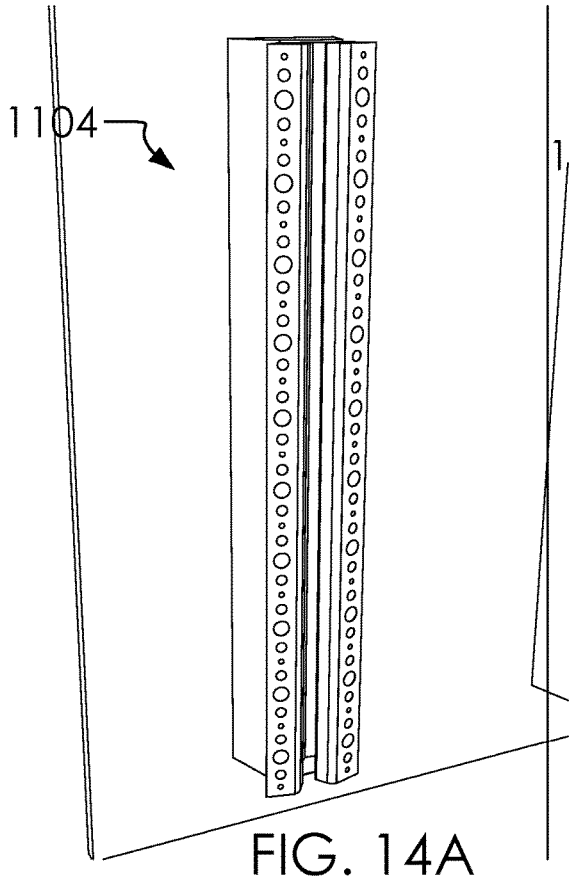
FIG. 14A illustrates a perspective overview of a housing.
Figure 14B:
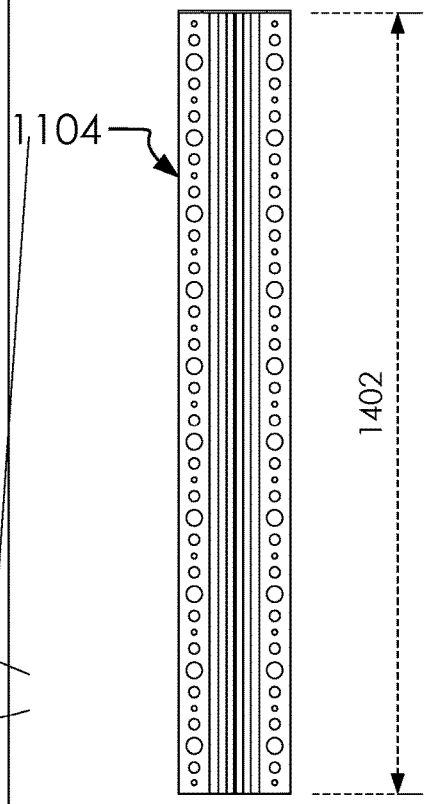
FIG. 14B illustrates an elevated front view of a housing.
Figure 14C:
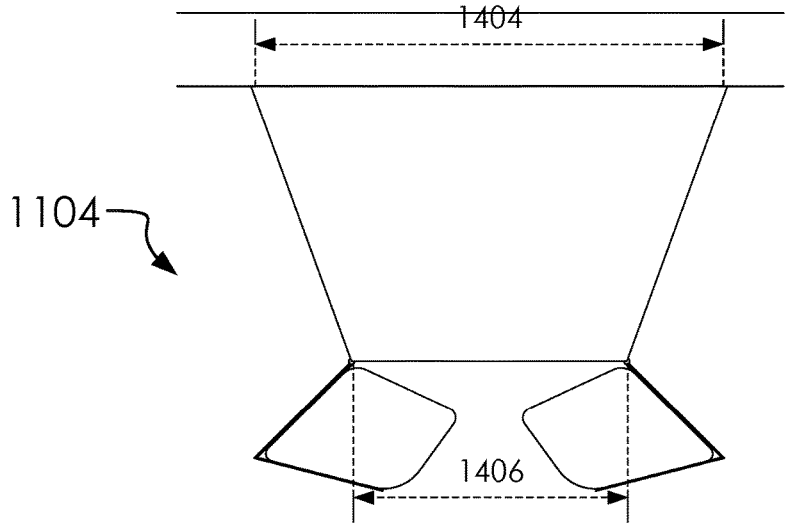
FIG. 14C illustrates an elevated top view of a housing.

FIG. 14A illustrates a perspective overview of a housing 1104. FIG. 14B illustrates an elevated front view of a housing 1104. FIG. 14C illustrates an elevated top view of a housing 1104.

Illustrated herein are a height 1402, a first width 1404, and a second width 1406.

Figure 15A:
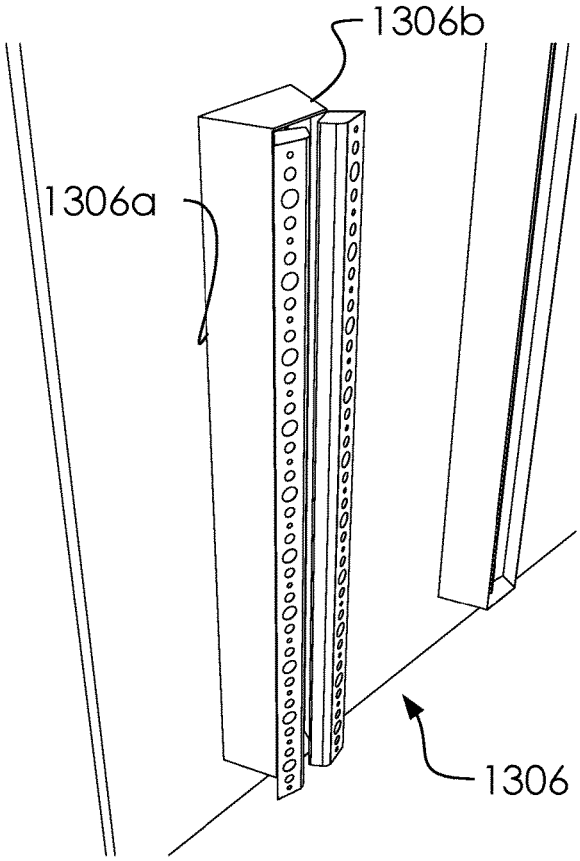
FIG. 15A illustrates a perspective overview of a back pads.
Figure 15B:
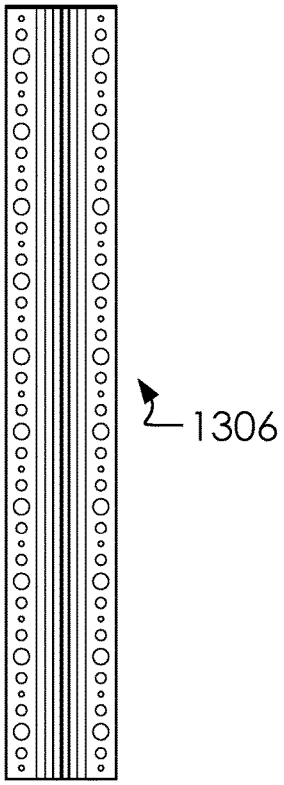
FIG. 15B illustrates an elevated front view of a back pads 1306.
Figure 15C:
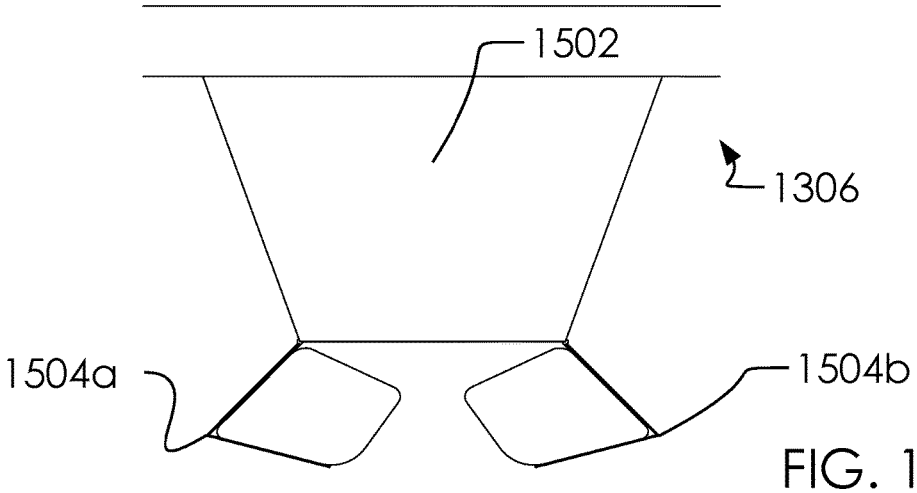
FIG. 15C illustrates an elevated top view of a back pads.

FIG. 15A illustrates a perspective overview of a back pads 1306. FIG. 15B illustrates an elevated front view of a back pads 1306. FIG. 15C illustrates an elevated top view of a back pads 1306.

Illustrated herein are a shared faces 1502, a first pointed end 1504*a*, and a second pointed end 1504*b*.

Figure 16A:
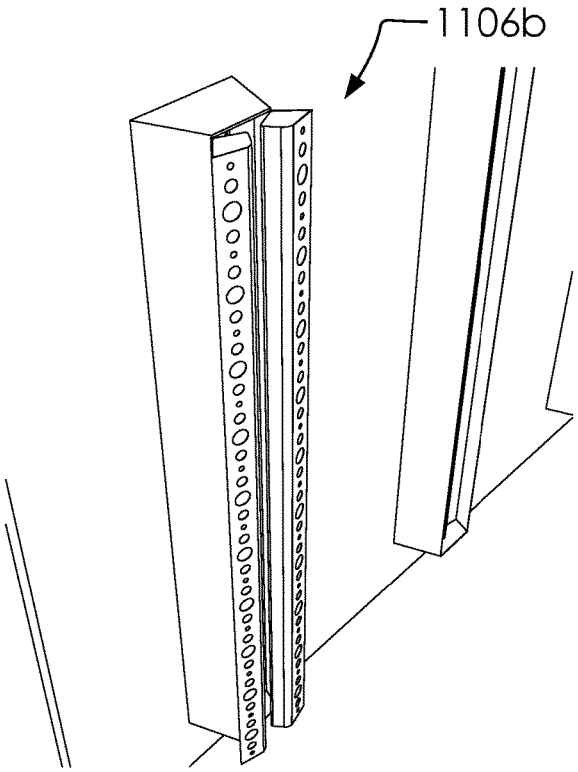
FIG. 16A illustrates a perspective overview of a second side door assembly.
Figure 16B:
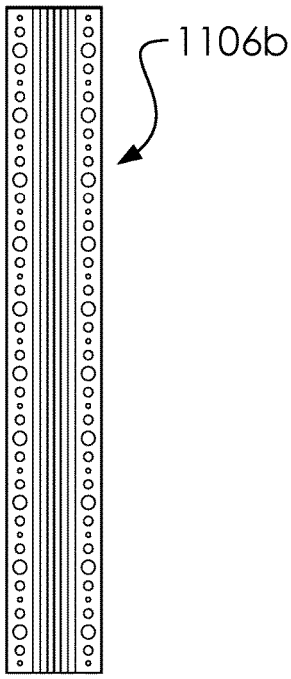
FIG. 16B illustrates an elevated front view of a second side door assembly.
Figure 16C:
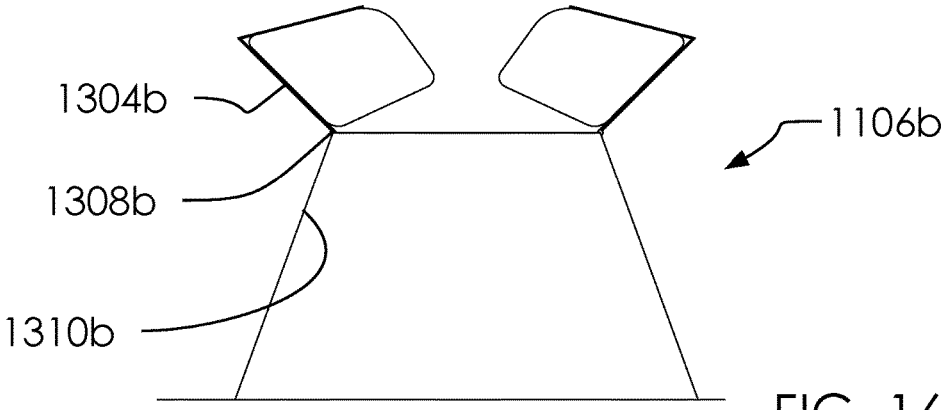
FIG. 16C illustrates an elevated top view of a second side door assembly.

FIG. 16A illustrates a perspective overview of a second side door assembly 1106*b*. FIG. 16B illustrates an elevated front view of a second side door assembly 1106*b*. FIG. 16C illustrates an elevated top view of a second side door assembly 1106*b*.

Figure 17A:
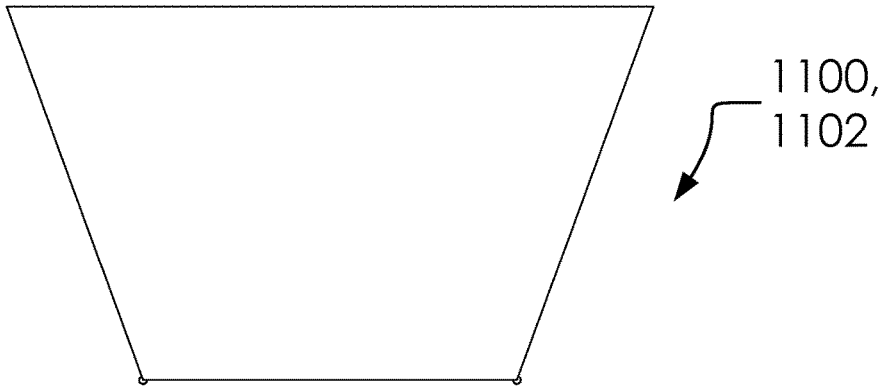
FIG. 17A illustrates an elevated top view of a closed configuration.
Figure 17B:
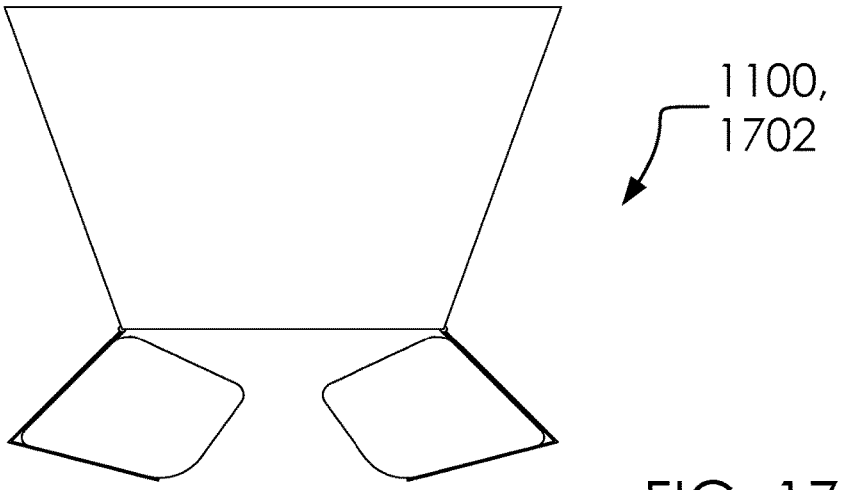
FIG. 17B illustrates an elevated top view of a second configuration.
Figure 17C:
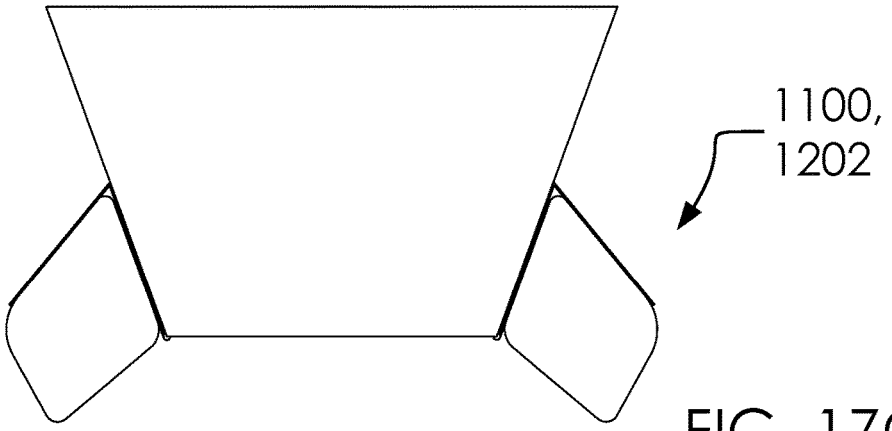
FIG. 17C illustrates an elevated top view of an open configuration.

FIG. 17A illustrates an elevated top view of a closed configuration 1102. FIG. 17B illustrates an elevated top view of a second configuration 1702. FIG. 17C illustrates an elevated top view of an open configuration 1202.

Illustrated herein are a second configuration 1702.

Figure 18:
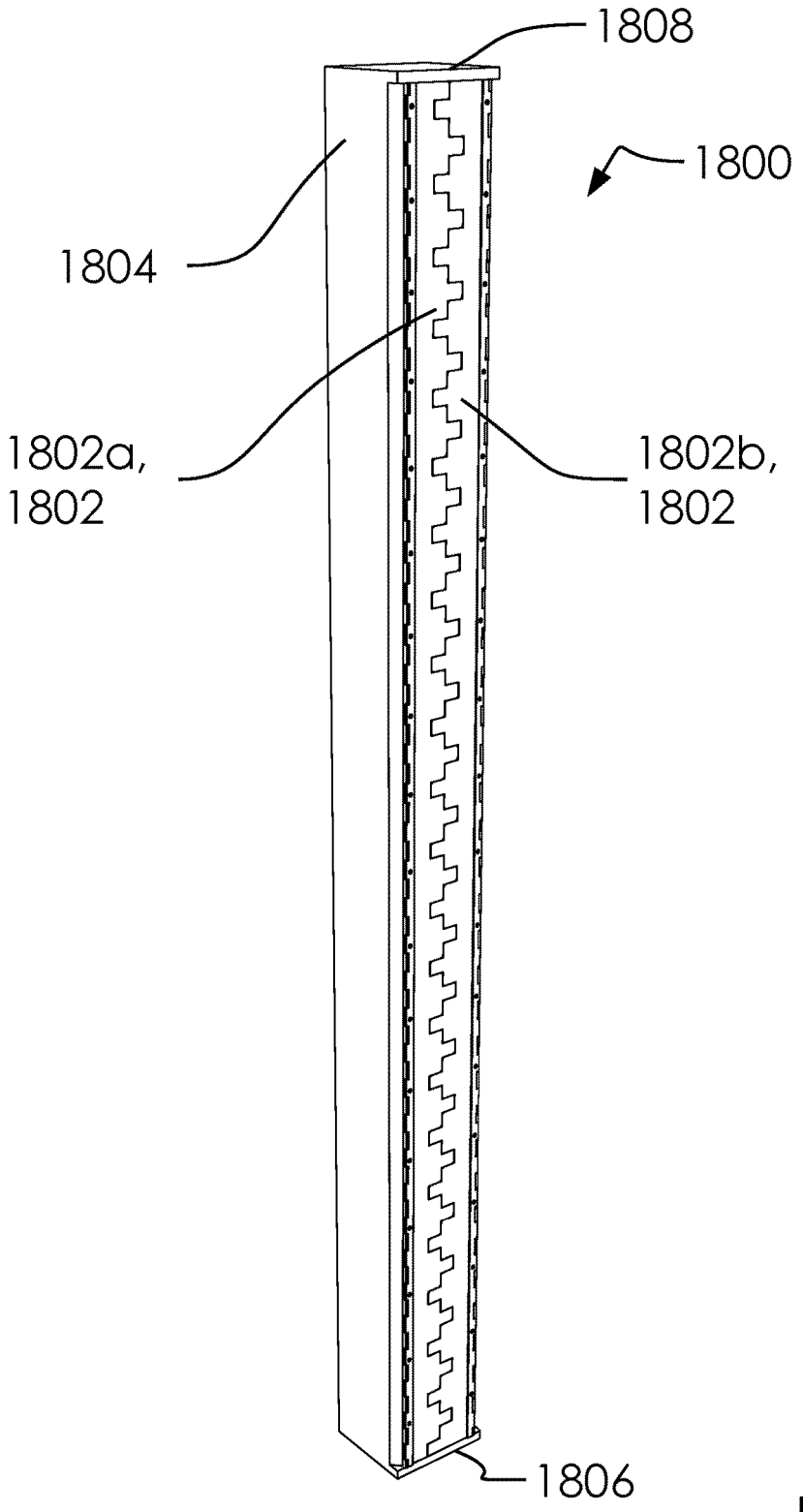
FIG. 18 illustrates a perspective overview of an interlocking variable acoustic assembly.

FIG. 18 illustrates a perspective overview of an interlocking variable acoustic assembly 1800.

Illustrated herein are an interlocking variable acoustic assembly 1800, an interlocking sides 1802, a first interlocking side 1802*a*, a second interlocking side 1802*b*, a housing 1804, a top portion 1806, a bottom portion 1808.

Figure 19A:
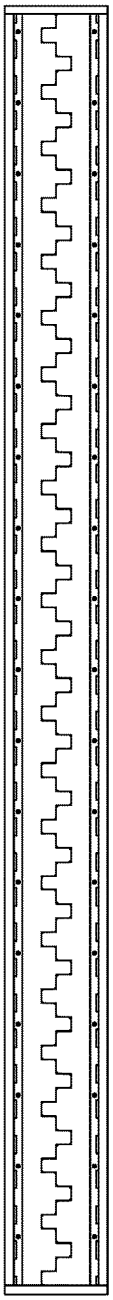
FIGS. 19A and 19B illustrate an elevated front view and a perspective detailed overview of an interlocking variable acoustic assembly.
Figure 19B:
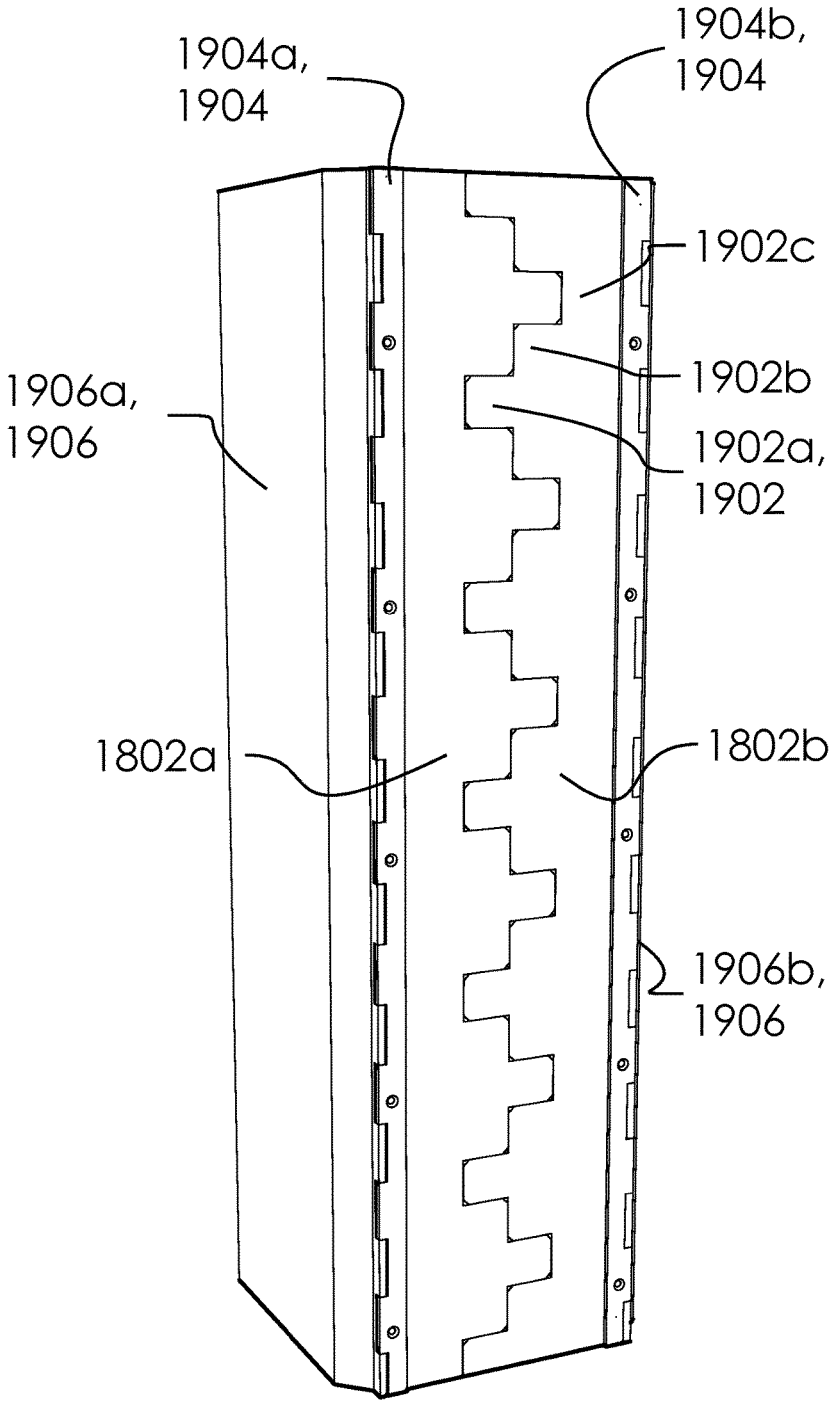

FIGS. 19A and 19B illustrate an elevated front view and a perspective detailed overview of an interlocking variable acoustic assembly 1800.

Illustrated herein are a one or more teeth 1902, a first tooth 1902*a*, a second tooth 1902*b*, a third tooth 1902*c*, a one or more hinges 1904, a first hinge 1904*a*, a second hinge 1904*b*, a sides 1906, a first side 1906*a*, a second side 1906*b*.

In one embodiment, said one or more hinges 1904 can comprise said first hinge 314*a*, said second hinge 314*b*.

Figure 20:
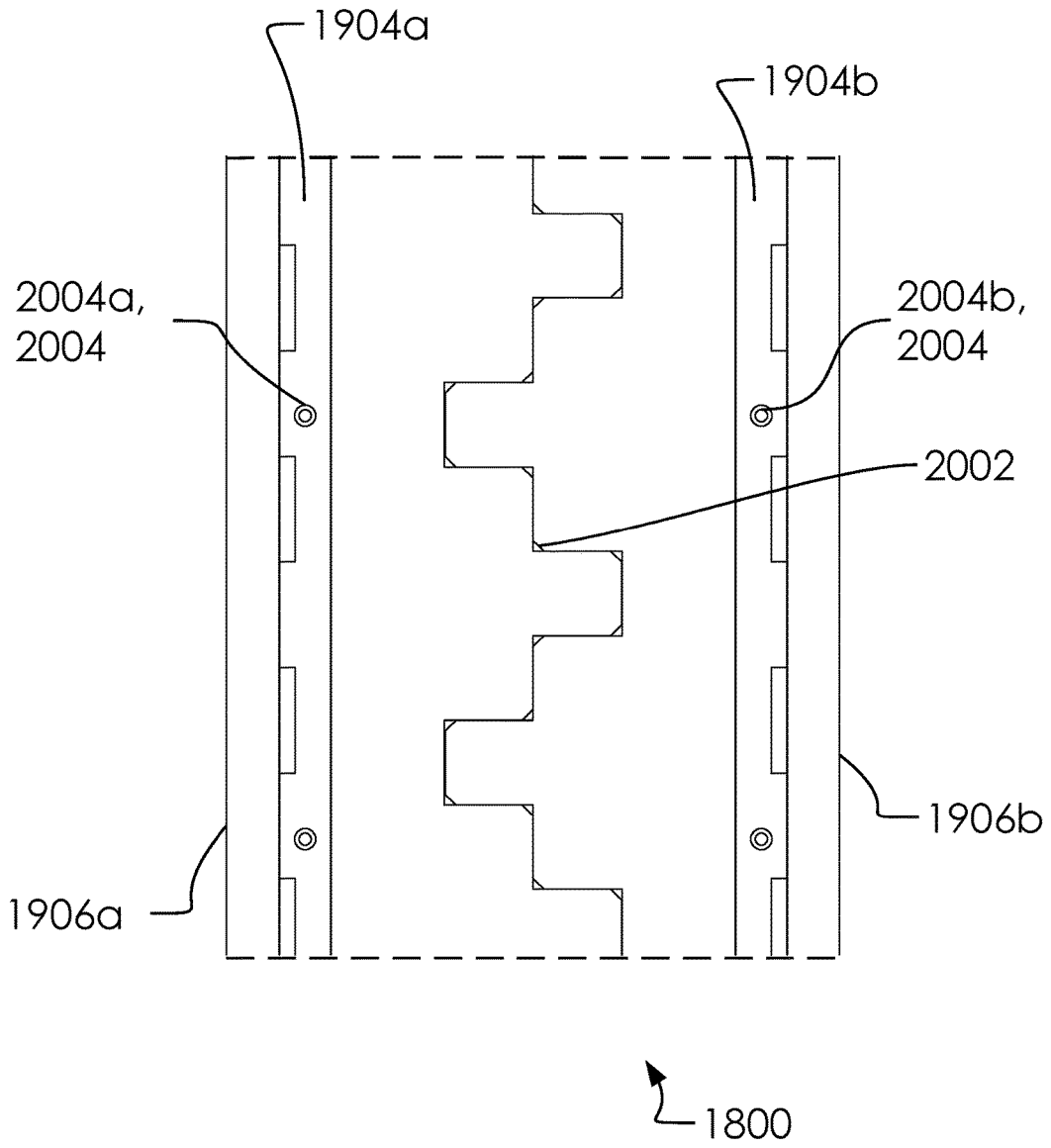
FIG. 20 illustrates an elevated detailed front view of an interlocking variable acoustic assembly.

FIG. 20 illustrates an elevated detailed front view of an interlocking variable acoustic assembly 1800.

Illustrated herein are a beveled edges 2002.

Figure 21A:
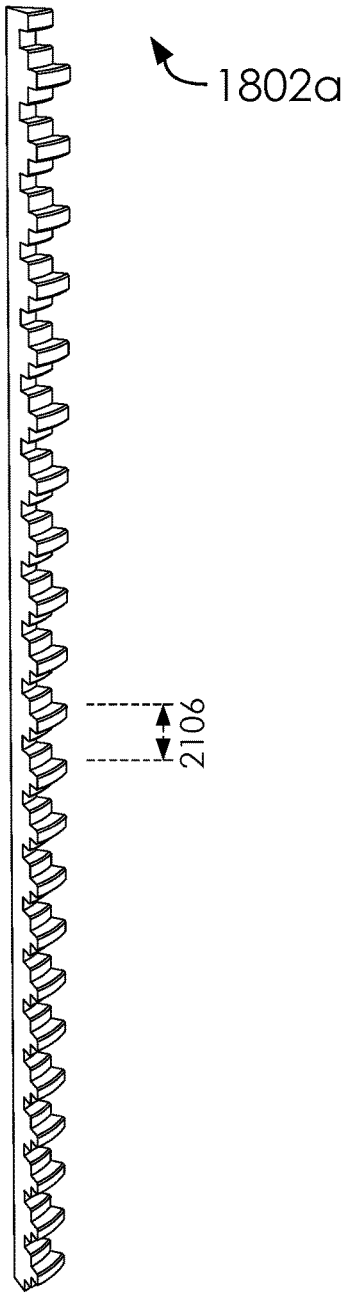
FIGS. 21A and 21B illustrate a perspective overview and an elevated front view of a first interlocking side.
Figure 21B:
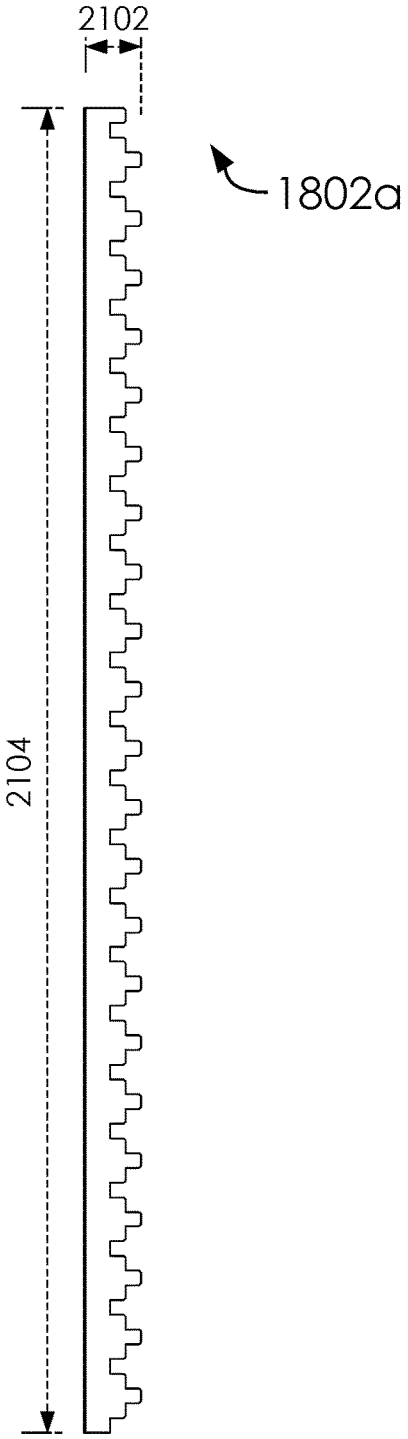

FIGS. 21A and 21B illustrate a perspective overview and an elevated front view of a first interlocking side 1802*a*.

Illustrated herein are a width 2102, a height 2104, and a tooth set height 2106.

Figure 22A:
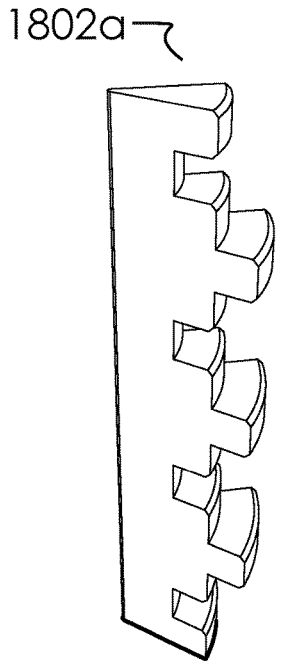
FIGS. 22A, 22B and 22C illustrate a perspective detailed overview, an elevated top view and an elevated side view of a first interlocking side.
Figure 22B:
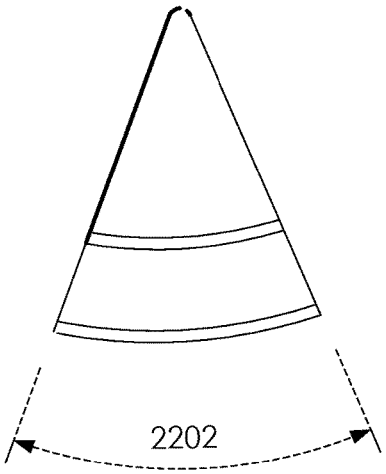
Figure 22C:
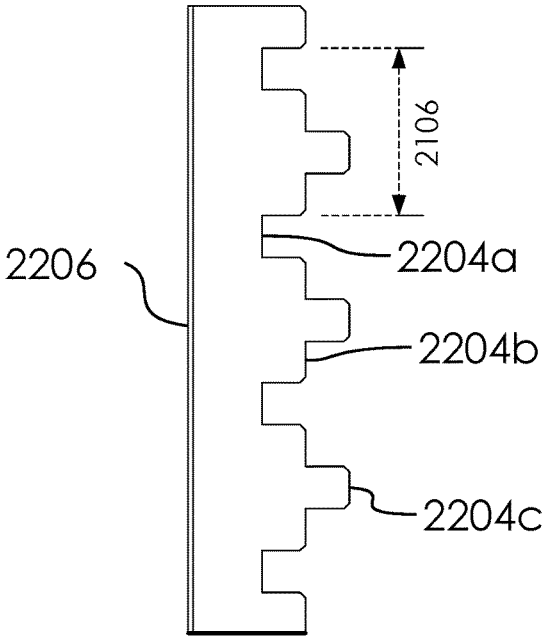

FIGS. 22A, 22B and 22C illustrate a perspective detailed overview, an elevated top view and an elevated side view of a first interlocking side 1802*a*.

Illustrated herein are a wedge angle 2202, a first face 2204*a*, a second face 2204*b*, a third face 2204*c*, and a wedge origin edge 2206.

Figure 23A:
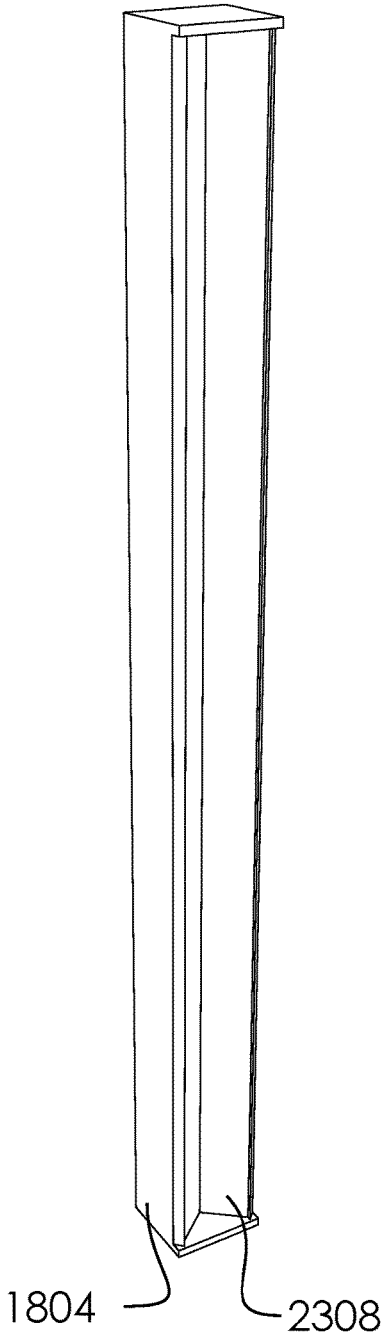
FIGS. 23A, 23B and 23C illustrate a perspective overview, an elevated front view and an elevated top view of a housing.
Figure 23B:
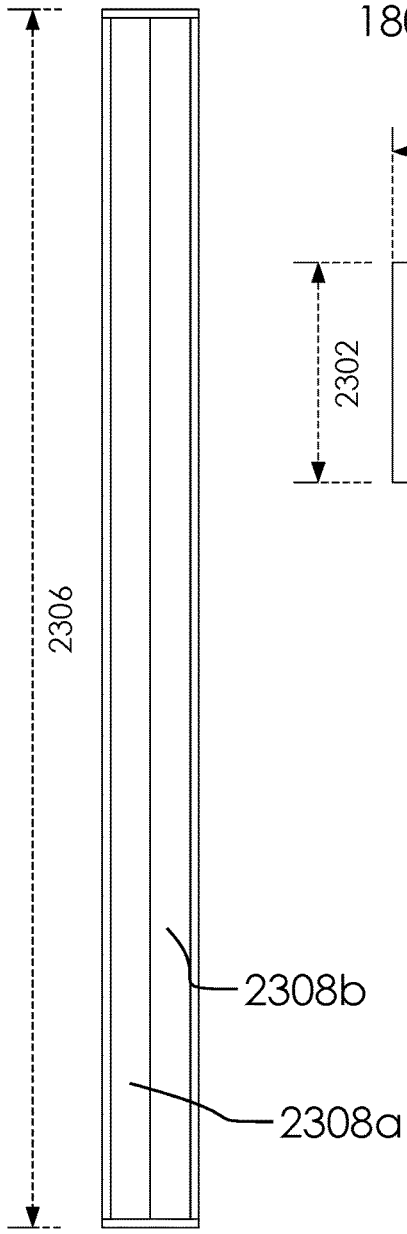
Figure 23C:
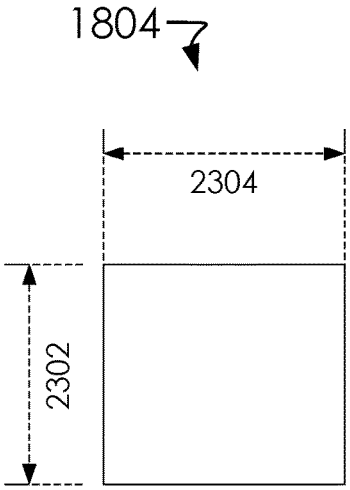

FIGS. 23A, 23B and 23C illustrate a perspective overview, an elevated front view and an elevated top view of a housing 1804.

Illustrated herein are a depth 2302, a width 2304, a height 2306, a one or more back absorbing pads 2308, a first absorbing pad 2308*a*, and a second absorbing pad 2308*b*.

Figure 24A:
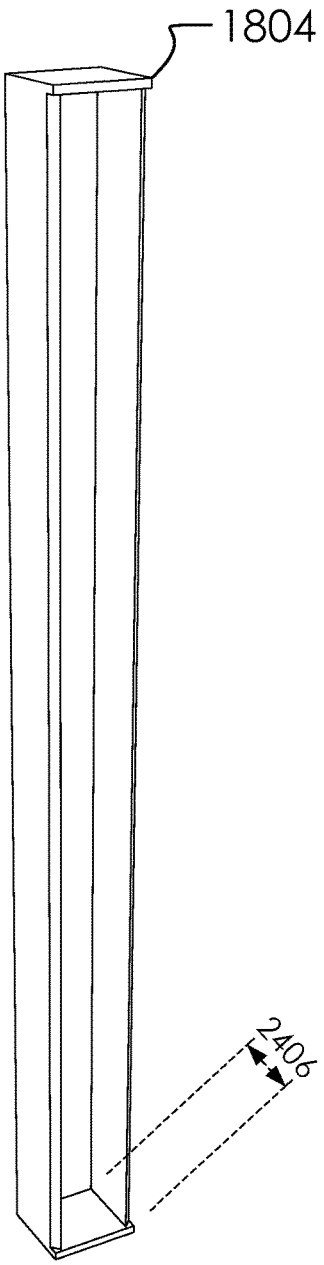
FIGS. 24A and 24B illustrate a perspective overview and an elevated front view of a housing.
Figure 24B:
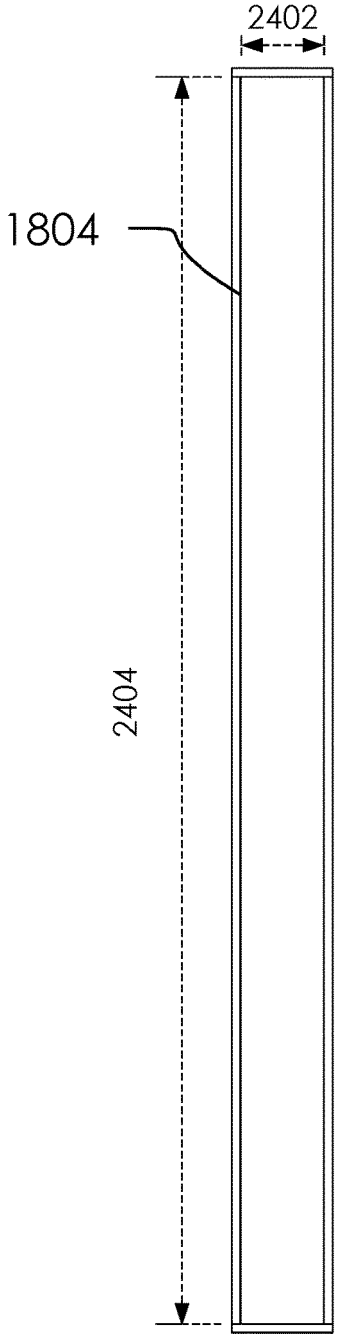

FIGS. 24A and 24B illustrate a perspective overview and an elevated front view of a housing 1804.

Illustrated herein are an interior width 2402, an interior height 2404, and an interior depth 2406.

Figure 25A:
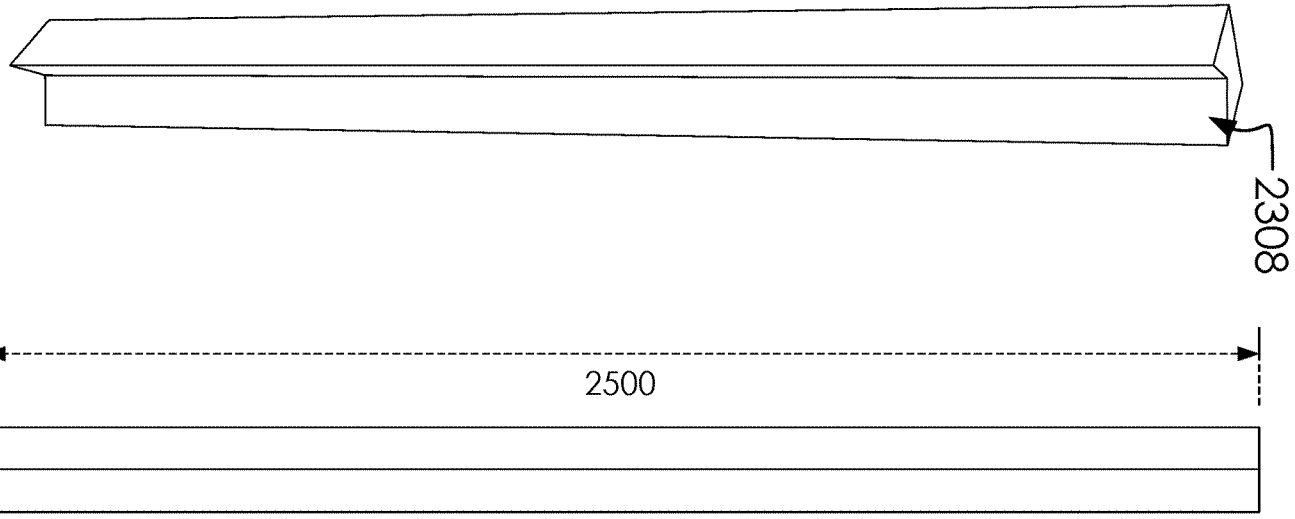
FIGS. 25A, 25B and 25C illustrate a perspective overview, an elevated front view and an elevated top view of a one or more back pads.
Figure 25B:
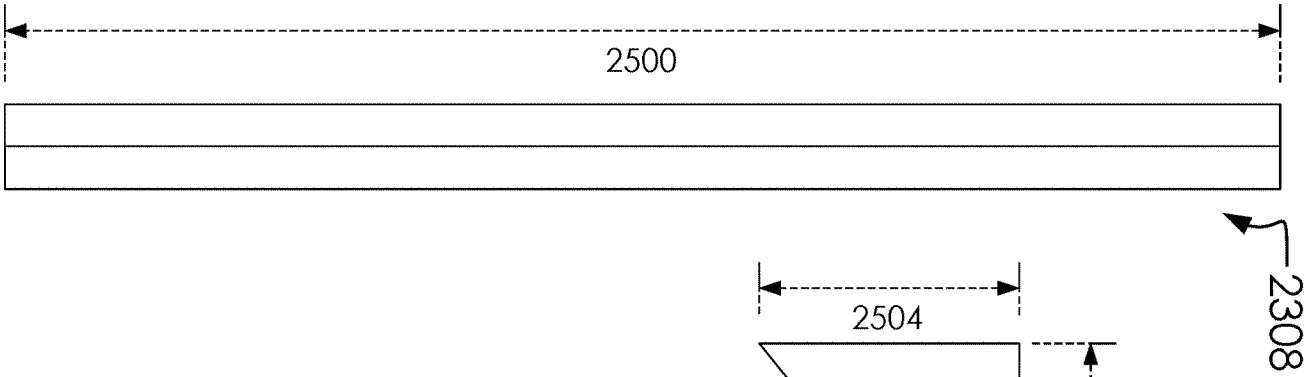
Figure 25C:
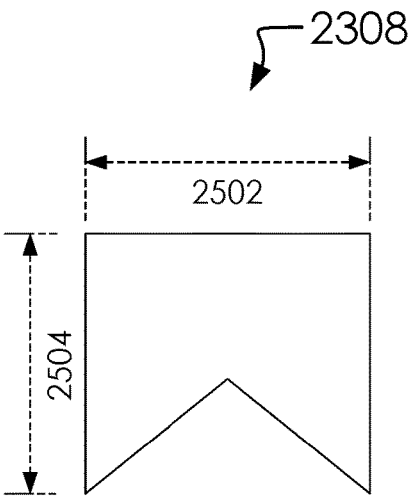
Figure 26A:
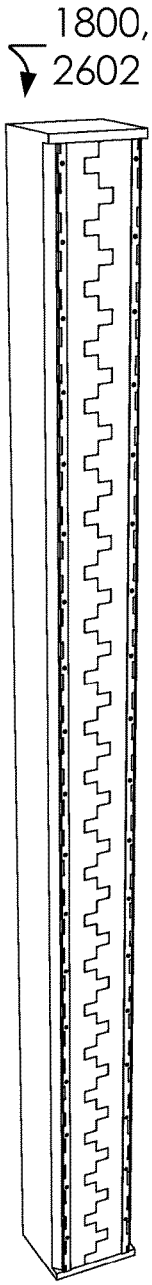
FIGS. 26A, 26B, 26C and 26D illustrate a perspective overview of an interlocking variable acoustic assembly in a closed configuration, a second configuration, a third configuration and an open configuration, respectively.
Figure 26B:
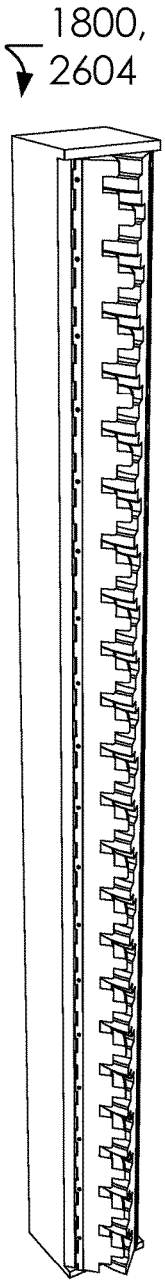
Figure 26C:
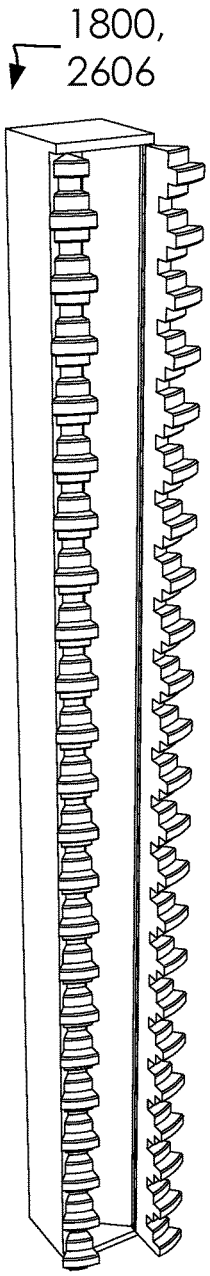
Figure 26D:
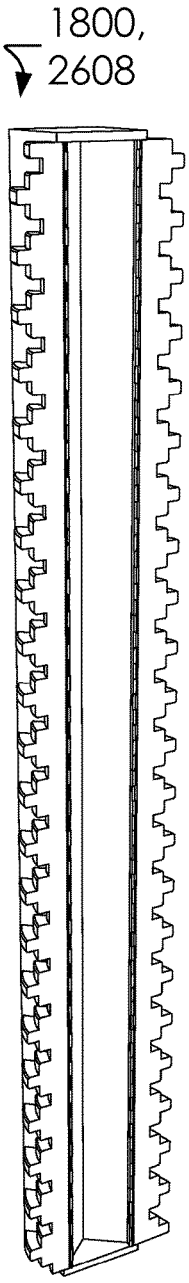
Figure 27A:
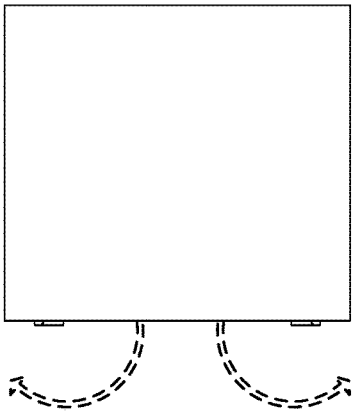
FIGS. 27A, 27B, 27C and 27D illustrate an elevated top view of said interlocking variable acoustic assembly in said closed configuration, said second configuration, said third configuration and said open configuration, respectively.
Figure 27B:
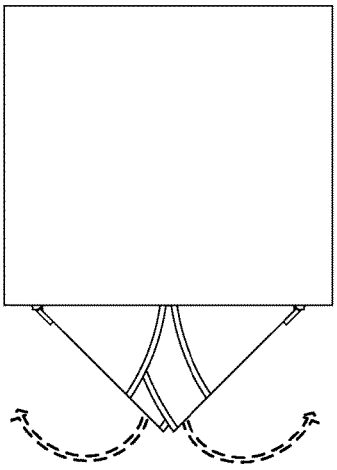
Figure 27C:
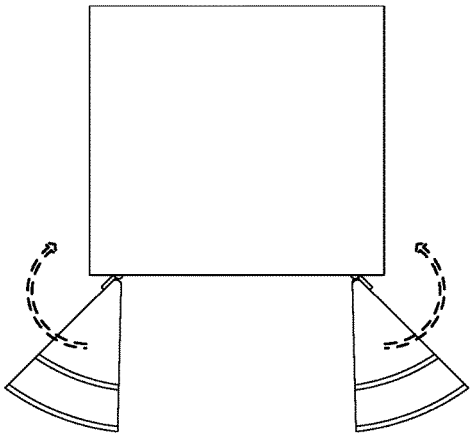
Figure 27D:
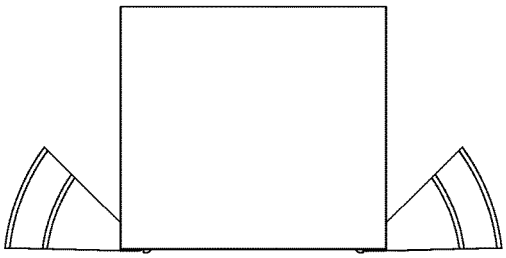

FIGS. 25A, 25B and 25C illustrate a perspective overview, an elevated front view and an elevated top view of a one or more back pads 2308.

Illustrated herein are a height 2500, a width 2502, and a depth 2504.

FIGS. 26A, 26B, 26C and 26D illustrate a perspective overview of an interlocking variable acoustic assembly 1800 in a closed configuration 2602, a second configuration 2604, a third configuration 2606 and an open configuration 2608, respectively.

In one embodiment, said open configuration 2608 can comprise said open width 306.

FIGS. 27A, 27B, 27C and 27D illustrate an elevated top view of said interlocking variable acoustic assembly 1800 in said closed configuration 2602, said second configuration 2604, said third configuration 2606 and said open configuration 2608, respectively.

Figure 28:
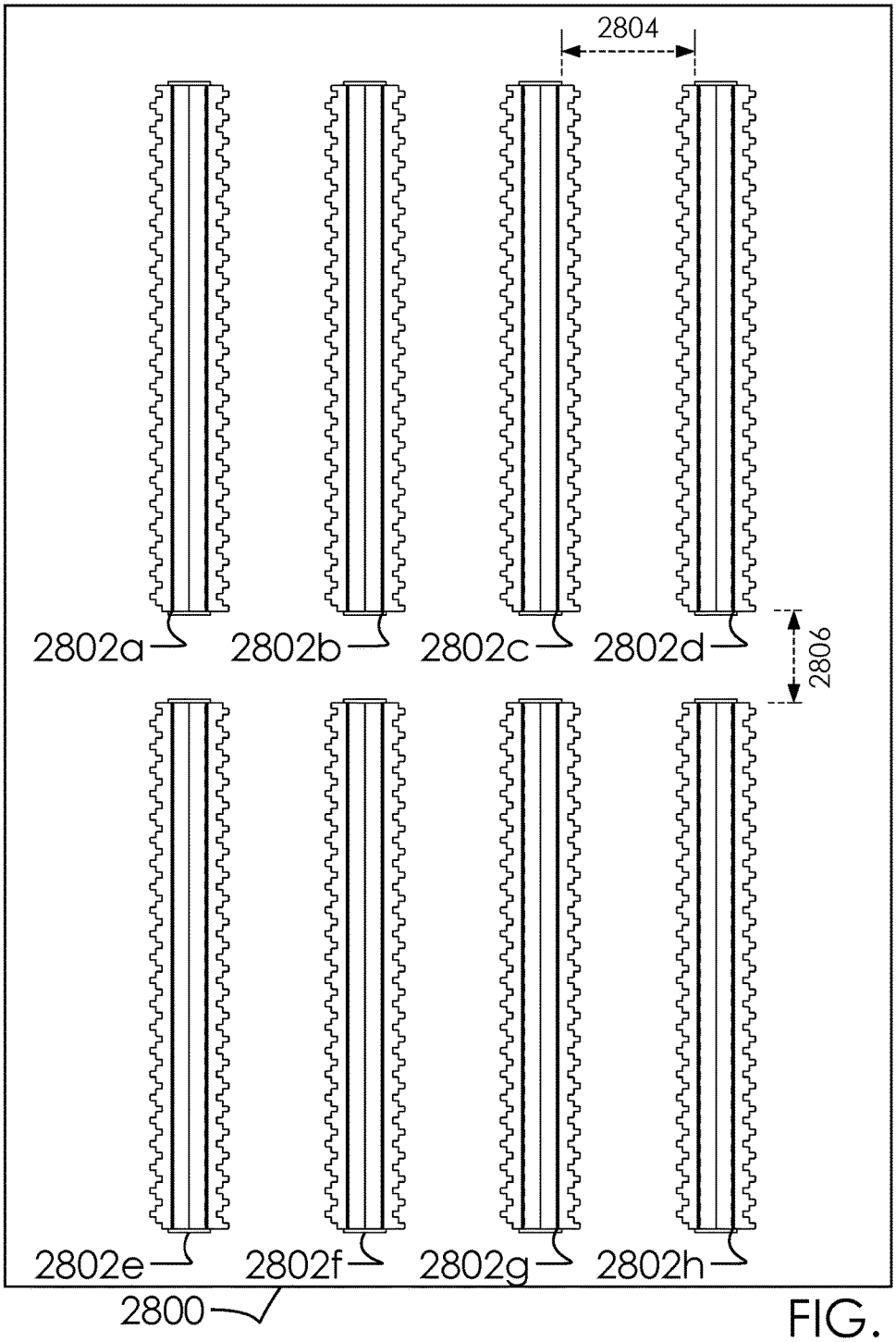
FIG. 28 illustrates an elevated front view of a plurality of interlocking variable acoustic assemblies 2802 on an acoustic target surface 2800.

FIG. 28 illustrates an elevated front view of a plurality of interlocking variable acoustic assemblies 2802 on an acoustic target surface 2800.

Illustrated herein are an acoustic target surface 2800, a plurality of interlocking variable acoustic assemblies 2802, a first system 2802*a*, a second system 2802*b*, a third system 2802*c*, a fourth system 2802*d*, a fifth system 2802*e*, a sixth system 2802*f*, a seventh system 2802*g*, an eighth system 2802*h*, a horizontal separation 2804, a vertical separation 2806.

Figure 29:
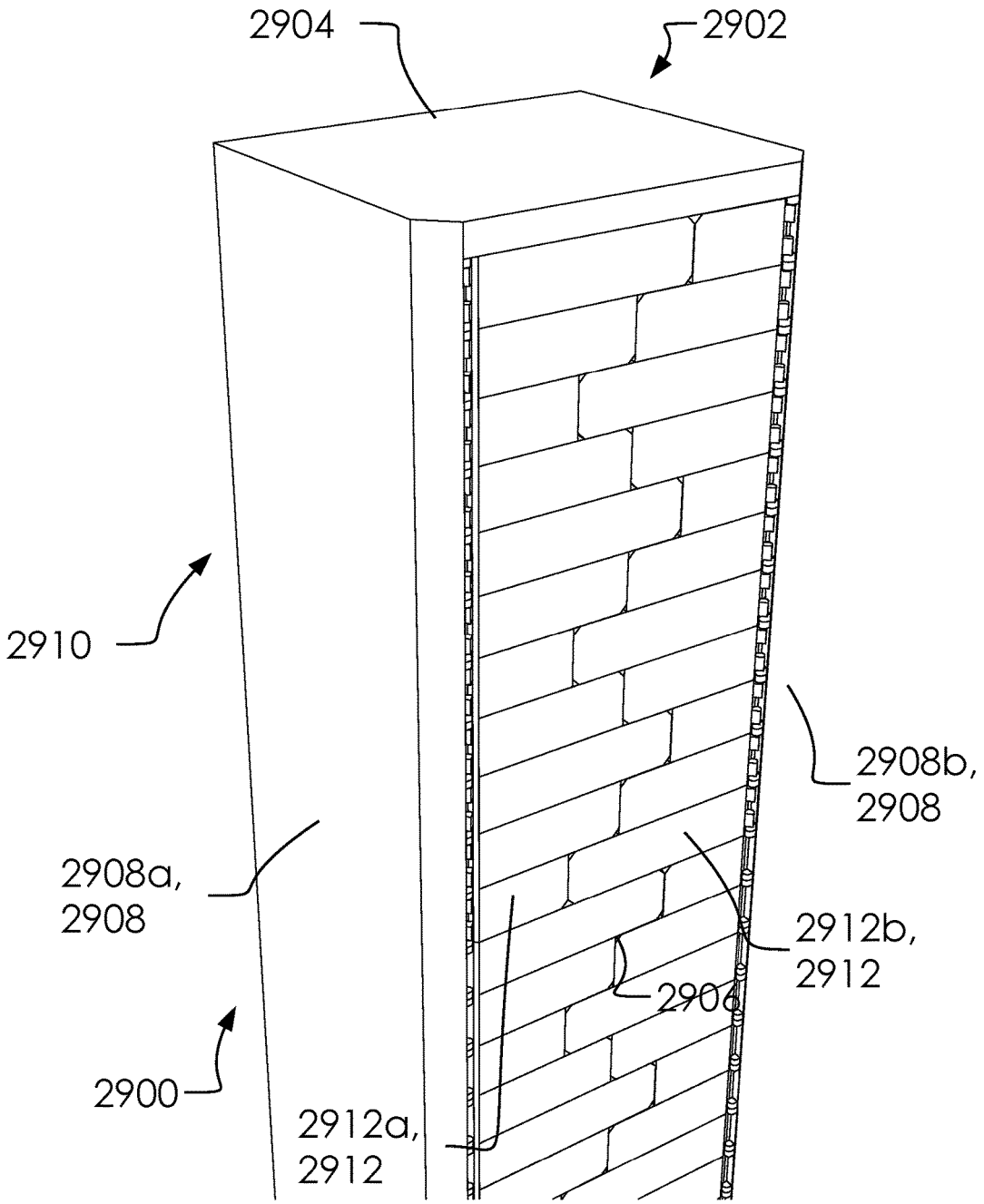
FIG. 29 illustrates a perspective overview of a compact interlocking variable acoustic assembly.
Figure 30A:
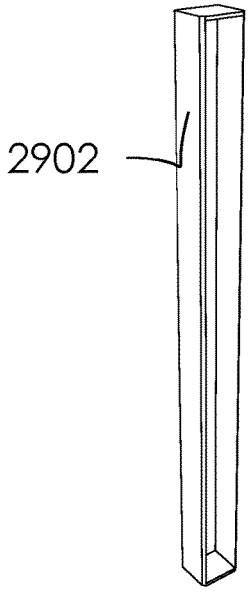
FIGS. 30A, 30B, 30C and 30D illustrate a perspective overview, an elevated top view, an elevated side view, and an elevated front view of a housing
Figure 30B:
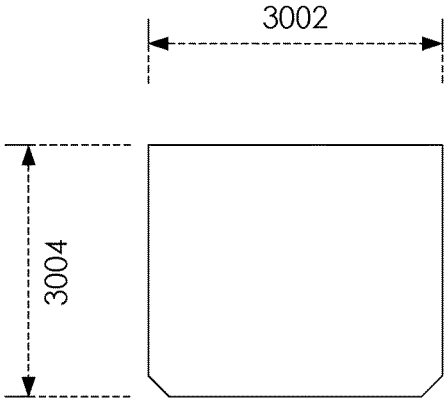
Figure 30C:
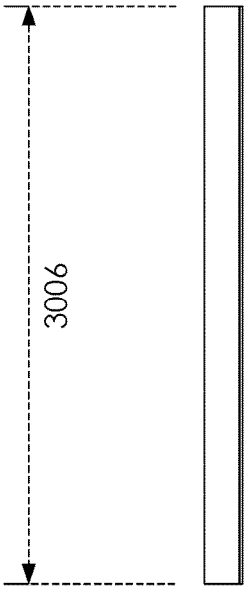
Figure 30D:
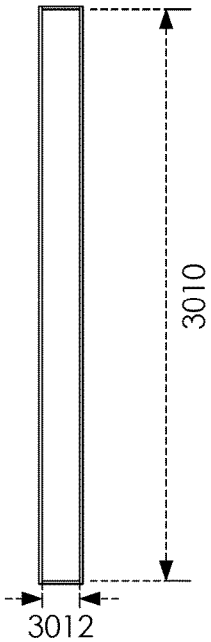
Figure 31A:
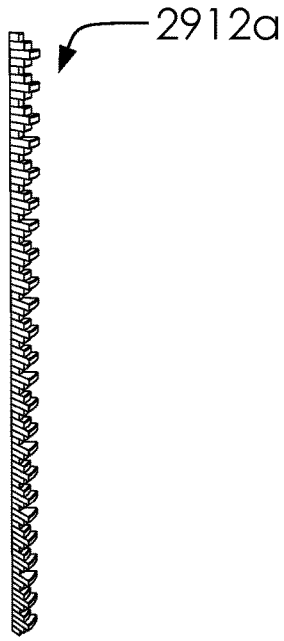
FIGS. 31A, 31B, 31C and 31D illustrate a perspective overview, an elevated top view, an elevated side view and a detailed elevated front view of a first interlocking side.
Figure 31B:
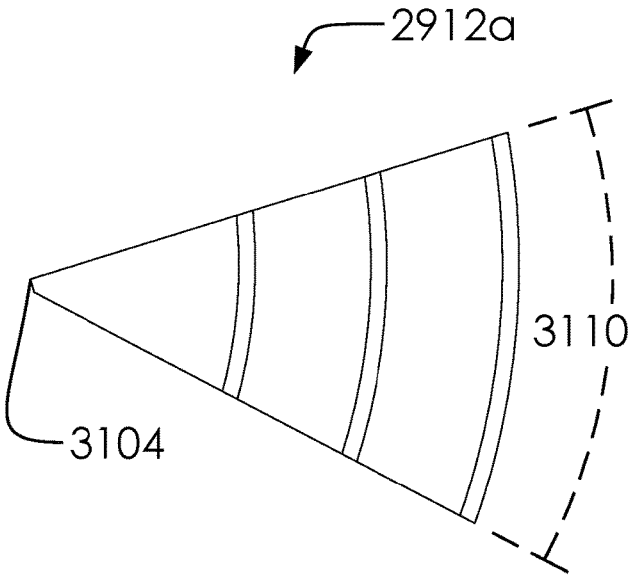
Figure 31C:
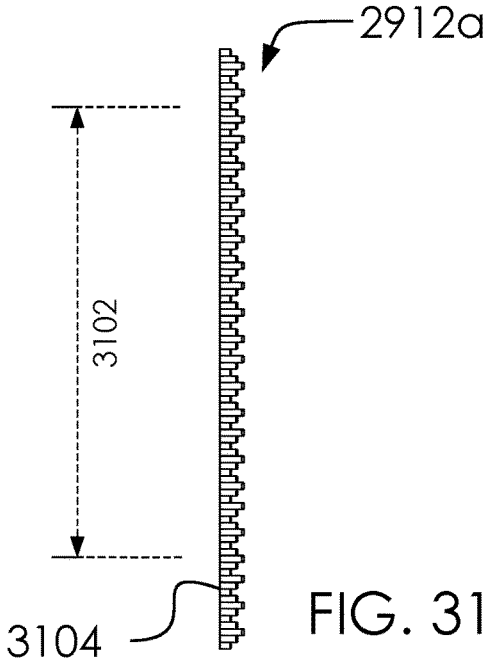
Figure 31D:
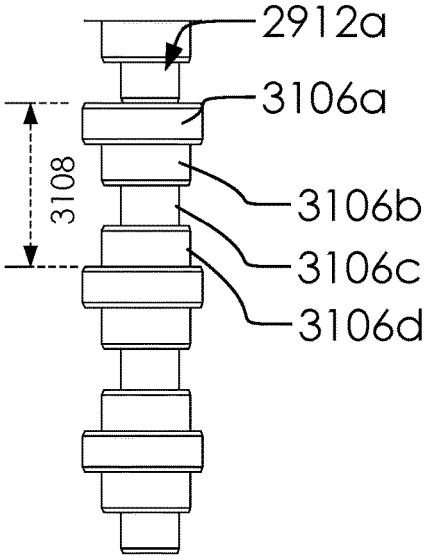

FIG. 29 illustrates a perspective overview of a compact interlocking variable acoustic assembly 2900.

Illustrated herein are a compact interlocking variable acoustic assembly 2900, a housing 2902, a top 2904, a bottom 2906, a sides 2908, a first side 2908*a*, a second side 2908*b*, a back insulation 2910, an interlocking sides 2912, a first interlocking side 2912*a*, a second interlocking side 2912*b*.

FIGS. 30A, 30B, 30C and 30D illustrate a perspective overview, an elevated top view, an elevated side view, and an elevated front view of a housing 2902.

Illustrated herein are a width 3002, a depth 3004, a height 3006, a back portion depth 3008, an interior height 3010, and an interior width 3012.

FIGS. 31A, 31B, 31C and 31D illustrate a perspective overview, an elevated top view, an elevated side view and a detailed elevated front view of a first interlocking side 2912*a*.

Illustrated herein are a height 3102, a wedge origin point 3104, a one or more interlocking teeth 3106, a first tooth 3106*a*, a second tooth 3106*b*, a third tooth 3106*c*, a fourth tooth 3106*d*, a tooth set 3108, a wedge angle 3110.

Figure 32A:
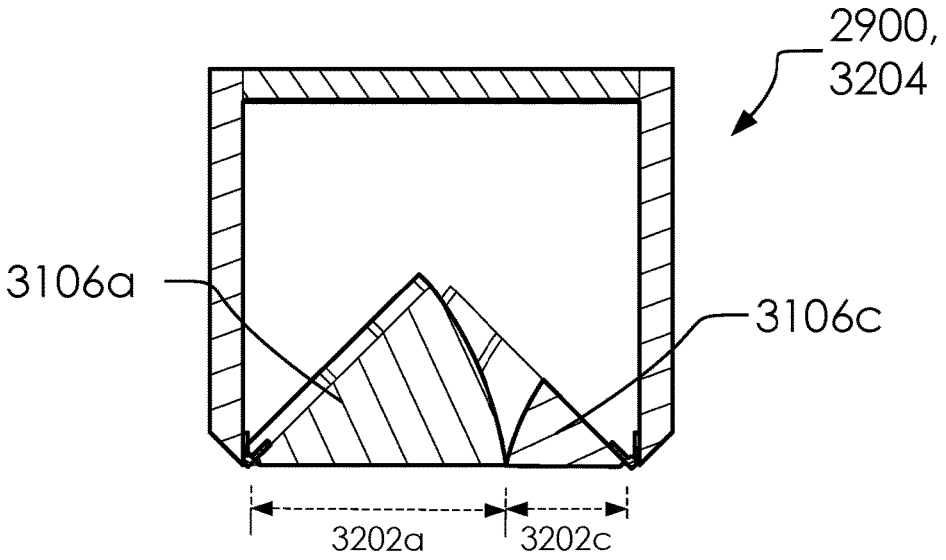
FIGS. 32A and 32B illustrate an elevated cross-section top view of said compact interlocking variable acoustic assembly in a closed configuration and a second configuration, respectively.
Figure 32B:
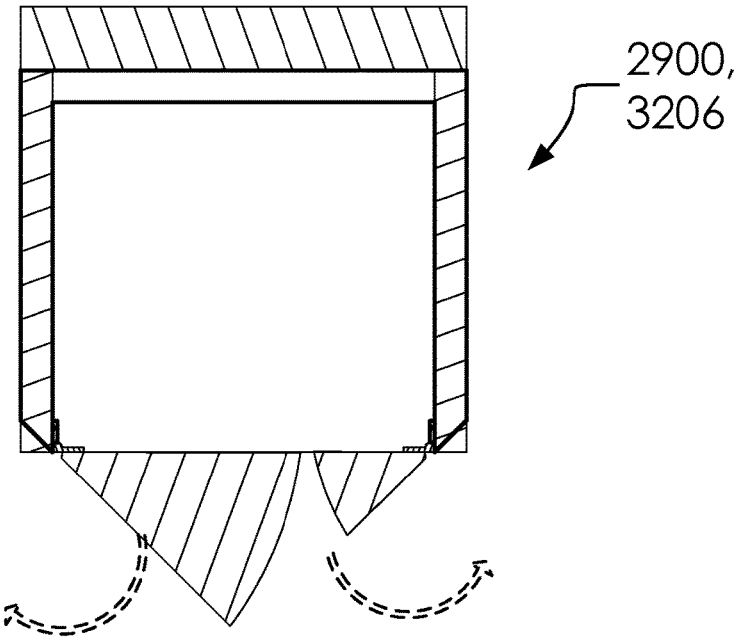

FIGS. 32A and 32B illustrate an elevated cross-section top view of said compact interlocking variable acoustic assembly 2900 in a closed configuration 3204 and a second configuration 3206, respectively.

Illustrated herein are a first width 3202*a*, a second width 3202*b*, a third width 3202*c*, a closed configuration 3204, and a second configuration 3206.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein.

The invention claimed is:

1. A variable acoustic assembly, wherein:

said variable acoustic assembly comprises a housing and a one or more absorbing pads;

said housing contains said one or more absorbing pads;

said housing comprises
- a two or more doors,
- a back portion, and
- a two or more hinges;

said two or more doors rotateably attach to opposite sides of said back portion with said two or more hinges;

said two or more doors are configured to selectively open and selectively close between an open configuration and a closed configuration by rotating on said two or more hinges;

said variable acoustic assembly comprises a closed width in said closed configuration and an open width in said open configuration;

said open width is greater than said closed width;

with said two or more doors in said open configuration, a portion of said one or more absorbing pads are exposed outside of said housing; and with said two or more doors in said closed configuration, said one or more absorbing pads are concealed inside of said housing;

said housing comprising a rigid material configured to substantially reflect a sound energy directed at said variable acoustic assembly;

said one or more absorbing pads comprise an absorbent material configured to substantially absorb said sound energy;

said two or more doors comprising a first side door and a second side door;

said two or more doors are configured to selectively rotate on said two or more hinges to enclose or reveal a portion of said one or more absorbing pads;

said two or more hinges comprise a vertical axis configured to allow said two or more doors to rotate between said closed configuration and said open configuration;

said two or more doors each comprise a first vertical edge and a second vertical edge;

said two or more doors comprise a first side door and a second side door;

said two or more hinges comprise a first hinge and a second hinge;

said first hinge rotateably attaches to said first vertical edge of said first side door;

said second hinge rotateably attaches to said first vertical edge of said second side door;

said second vertical edges of said first side door and said second side door selectively seal to one another with said two or more doors in said closed configuration; and in said closed configuration, said two or more doors comprise a rounded shape configured to reflect a sound energy directed at said variable acoustic assembly.

2. The variable acoustic assembly of claim 1 wherein:

said housing comprises
- said back portion,
- said two or more doors,
- a top portion and
- a bottom portion;

said back portion and said two or more doors enclose an interior volume; and said one or more absorbing pads are contained within said interior volume.

3. The variable acoustic assembly of claim 2 wherein:
said one or more absorbing pads comprise
a one or more back absorbing pads and
a front absorbing pads;
said one or more back absorbing pads are enclosed in said back portion of said housing;
said front absorbing pads are enclosed within said two or more doors;
said front absorbing pads comprise a first absorbing pad and a second absorbing pad;
said first absorbing pad is enclosed within a portion of said first side door; and
said second absorbing pad is enclosed within a portion of said second side door.

4. The variable acoustic assembly of claim 3 wherein:
said front absorbing pads are wedge shaped; and
said one or more back absorbing pads and said front absorbing pads substantially fill said interior volume.

5. The variable acoustic assembly of claim 4 wherein:
said two or more doors are affixed to opposite sides of said back portion on said two or more hinges;
said hinges rotate about a substantially vertical axis; and
said two or more doors are configured to open to said open configuration to expose portions of said one or more absorbing pads.

6. The variable acoustic assembly of claim 5 wherein:
said variable acoustic assembly is configured to selectively attach to a wall with said back portion being attached to said wall and said two or more doors extending out from said wall.

7. The variable acoustic assembly of claim 1 wherein:
said housing containing a two or more inner diffusers;
said two or more inner diffusers are substantially planar and of a rigid material configured to substantially diffuse a sound energy;
wherein, with said two or more doors are in said open configuration,
a portion of said two or more inner diffusers and said one or more absorbing pads are exposed outside of said housing; and
wherein, with said two or more doors are in said closed configuration,
said two or more inner diffusers are concealed inside of said housing.

8. The variable acoustic assembly of claim 7 wherein:
said two or more inner diffusers comprise a one or more diffusing gaps which are configured to expose a portion of said one or more absorbing pads arranged behind said two or more inner diffusers; and
said two or more inner diffusers comprise a one or more diffusing portions between a portion of said one or more diffusing gaps; and
said one or more diffusing gaps and said one or more diffusing portions are arranged on said one or more diffusers to create a binary amplitude diffusion of acoustic energy.

9. The variable acoustic assembly of claim 1 wherein:
said open width is about double that of said closed width.

10. The variable acoustic assembly of claim 1 wherein:
said one or more absorbing pads consist of a material chosen among fiberglass material and Rockwool.

11. The variable acoustic assembly of claim 1 wherein:
said variable acoustic assembly further comprises a controller system and a linear actuator motors;
said linear actuator motors comprise a first end attached to a portion of said housing and a second end attached to said two or more doors; and
said controller system is selectively engaged to open and close said two or more doors using said linear actuator motors.

12. The variable acoustic assembly of claim 1 wherein:
said variable acoustic assembly further comprises a controller system and a one or more rotary motors;
said one or more rotary motors comprise a first portion attached to a portion of said housing and a second portion attached to said two or more doors; and
said controller system is selectively engaged to open and close said two or more doors using said one or more rotary motors.

13. A method of using a variable acoustic assembly, comprising:
arranging a one or more variable acoustic assemblies on a surface,
transitioning said variable acoustic assembly between a closed configuration and an open configuration,
exposing a portion of a one or more absorbing pads with said variable acoustic assembly in said open configuration so as to absorb a sound energy directed toward said variable acoustic assembly, and
concealing said one or more absorbing pads and exposing a portion of a housing with said variable acoustic assembly in said closed configuration so as to diffuse said sound energy directed toward said variable acoustic assembly; wherein,
said variable acoustic assembly comprising said housing and said one or more absorbing pads;
said housing contains said one or more absorbing pads;
said housing comprises
a two or more doors,
a back portion, and
a two or more hinges;
said two or more doors rotateably attach to opposite sides of said back portion with said two or more hinges;
said two or more doors are configured to selectively open and selectively close between said open configuration and said closed configuration by rotating on said two or more hinges;
said variable acoustic assembly comprises a closed width in said closed configuration and an open width in said open configuration;
said open width is greater than said closed width;
with said two or more doors in said open configuration, a portion of said one or more absorbing pads are exposed outside of said housing; and
with said two or more doors in said closed configuration, said one or more absorbing pads are concealed inside of said housing;
said housing comprising a rigid material configured to substantially reflect a sound energy directed at said variable acoustic assembly;
said one or more absorbing pads comprise an absorbent material configured to substantially absorb said sound energy;
said two or more doors comprising a first side door and a second side door;
said two or more doors are configured to selectively rotate on said two or more hinges to enclose or reveal a portion of said one or more absorbing pads;
said two or more hinges comprise a vertical axis configured to allow said two or more doors to rotate between said closed configuration and said open configuration;
said two or more doors each comprise a first vertical edge and a second vertical edge;

said two or more doors comprise a first side door and a second side door;

said two or more hinges comprise a first hinge and a second hinge;

said first hinge rotateably attaches to said first vertical edge of said first side door;

said second hinge rotateably attaches to said first vertical edge of said second side door;

said second vertical edges of said first side door and said second side door selectively seal to one another with said two or more doors in said closed configuration; and in said closed configuration, said two or more doors comprise a rounded shape configured to reflect a sound energy directed at said variable acoustic assembly.

14. The variable acoustic assembly of claim 1 wherein:

said back portion comprises a two or more rear brackets, and a one or more French cleats;

said two or more rear brackets attach at either side of said back portion;

said two or more hinges attach to a portion of said two or more rear brackets;

said one or more French cleats are configured for hanging said variable acoustic assembly on a surface such as a wall;

each of said one or more French cleats comprise a first portion and a second portion;

said second portion are configured to be attached to said surface;

said first portion is configured to be attached to said variable acoustic assembly; and said first portion and said second portion selectively attach to one another.

15. The variable acoustic assembly of claim 1 wherein:

said second vertical edge of said first side door is concave;

said second vertical edge of said second side door is convex; and said second vertical edges of said two or more doors selectively seal to one another with said two or more doors in said closed configuration.

16. A variable acoustic assembly, wherein:

said variable acoustic assembly comprises a housing and a one or more absorbing pads;

said housing contains said one or more absorbing pads;

said housing comprises a two or more doors, a back portion, and a two or more hinges;

said two or more doors rotateably attach to opposite sides of said back portion with said two or more hinges;

said two or more doors are configured to selectively open and selectively close between an open configuration and a closed configuration by rotating on said two or more hinges;

said variable acoustic assembly comprises a closed width in said closed configuration and an open width in said open configuration;

with said two or more doors in said open configuration, a portion of said one or more absorbing pads are exposed outside of said housing; and with said two or more doors in said closed configuration, said one or more absorbing pads are concealed inside of said housing;

said housing containing a two or more inner diffusers;

said two or more inner diffusers are substantially planar and of a rigid material configured to substantially diffuse a sound energy;

wherein, with said two or more doors are in said open configuration, a portion of said two or more inner diffusers and said one or more absorbing pads are exposed outside of said housing;

wherein, with said two or more doors are in said closed configuration, said two or more inner diffusers are concealed inside of said housing; and said two or more inner diffusers comprise a one or more diffusing gaps which are configured to expose a portion of said one or more absorbing pads arranged behind said two or more inner diffusers.

17. The variable acoustic assembly of claim 16 wherein:

said two or more inner diffusers comprise a one or more diffusing portions between a portion of said one or more diffusing gaps; and said one or more diffusing gaps and said one or more diffusing portions are arranged on said one or more diffusers to create a binary amplitude diffusion of acoustic energy.

18. The variable acoustic assembly of claim 16 wherein:

said one or more absorbing pads comprise a first back absorbing pad and a second back absorbing pad; and with said two or more doors are in said closed configuration, portions of said two or more inner diffusers press into one another and slide between said first back absorbing pad and said second back absorbing pad.

* * * * *